US010851514B2

(12) United States Patent
Burnquist

(10) Patent No.: US 10,851,514 B2
(45) Date of Patent: Dec. 1, 2020

(54) BUILDING BLOCK AND METHODS

(71) Applicant: ANCHOR WALL SYSTEMS, INC., Minnetonka, MN (US)

(72) Inventor: Robert Brian Burnquist, Chaska, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 16/342,774

(22) PCT Filed: Oct. 18, 2016

(86) PCT No.: PCT/US2016/057530
§ 371 (c)(1),
(2) Date: Apr. 17, 2019

(87) PCT Pub. No.: WO2018/075014
PCT Pub. Date: Apr. 26, 2018

(65) Prior Publication Data
US 2019/0257054 A1 Aug. 22, 2019

(51) Int. Cl.
*E02D 29/02* (2006.01)
*E04B 2/18* (2006.01)
(Continued)

(52) U.S. Cl.
CPC ..... *E02D 29/025* (2013.01); *E02D 29/0266* (2013.01); *E04B 2/12* (2013.01);
(Continued)

(58) Field of Classification Search
CPC ..... E02D 29/025; E02D 29/0266; E04B 2/12; E04B 2/22; E04B 2/18; E04B 2002/0223;
(Continued)

(56) References Cited

U.S. PATENT DOCUMENTS 3,390,502 A * 7/1968 Carroll ..... E04B 2/06 52/424
5,252,017 A * 10/1993 Hodel ..... E02D 29/025 403/292

(Continued)

FOREIGN PATENT DOCUMENTS

| | | |
|---|---|---|
| DE | 20 2008 006 971 U1 | 7/2008 |
| GB | 645 610 A | 6/1942 |
| WO | 03/062538 A2 | 7/2003 |

OTHER PUBLICATIONS

International Search Report and Written Opinion of the International Searching Authority for International Patent Application No. PCT/US2016/057530 dated Jul. 13, 2017, 15 pages.

*Primary Examiner* — Jessie T Fonseca
(74) *Attorney, Agent, or Firm* — Merchant & Gould P.C.

(57) ABSTRACT

A concrete building block (30) includes a body (32) having opposite first (34) and second sides (36), opposite first (38) and second end faces (40) extending between the first and second sides (34, 36), and opposite first (42) and second bearing faces (44) extending between the first and second sides (34, 36) and the first and second end faces (38, 40). The first side has a first section (52) and second section (54). The first section (52) and first end face (38) are shaped to mate with each other when a like block (30) is rotated 90° and oriented adjacent thereto so that the center plane for the two blocks (30) are perpendicular to each other; and the second section (54) and second end face (40) are shaped to mate with each other when a like block (30) is rotated 90° and oriented adjacent thereto so that the center plane for the two blocks (30) are perpendicular to each other. The building block (30) can be used for structures such as a free standing wall, retaining wall, garden wall, or columns.

17 Claims, 31 Drawing Sheets

(51) Int. Cl.
*E04B 2/22* (2006.01)
*E04C 1/39* (2006.01)
*E04B 2/12* (2006.01)

(52) U.S. Cl.
CPC ..... *E04B 2/18* (2013.01); *E04B 2/22* (2013.01); *E04C 1/395* (2013.01); *E02D 2200/1657* (2013.01); *E02D 2250/0023* (2013.01); *E02D 2300/002* (2013.01)

(58) Field of Classification Search
CPC ..... E04B 2002/0263; E04B 2/02; E04B 2002/0213; E04C 1/395; E04C 1/00; E04H 17/1404
See application file for complete search history.

(56) References Cited

U.S. PATENT DOCUMENTS 5,535,568 A * 7/1996 Quinn ..... E02D 29/0266 405/284
5,622,456 A 4/1997 Risi et al.
5,943,827 A * 8/1999 Okerlund ..... E04C 1/395 362/147
5,951,210 A * 9/1999 Maguire ..... E02D 29/0225 405/284
D458,693 S * 6/2002 Sievert ..... D25/113
D464,149 S * 10/2002 Risi ..... D25/113
D464,440 S * 10/2002 Risi ..... D25/113
D465,855 S * 11/2002 Risi ..... D25/113
D466,229 S * 11/2002 Risi ..... D25/113
D485,371 S * 1/2004 Burgess ..... D25/113
7,963,727 B1 * 6/2011 Wauhop ..... E02D 29/0266 405/284
D829,934 S * 10/2018 Burnquist ..... D25/115
2001/0029709 A1 10/2001 Anderson
2001/0054268 A1 12/2001 Coleman
2002/0023403 A1 2/2002 Whitson
2003/0012608 A1 * 1/2003 Race ..... E02D 29/0241 405/284
2004/0159065 A1 * 8/2004 Burgess ..... E02D 29/025 52/574
2005/0102949 A1 * 5/2005 Whitson ..... E04C 1/395 52/596
2006/0110223 A1 * 5/2006 Dawson ..... B28B 3/021 405/286
2009/0103988 A1 * 4/2009 Allington ..... E02D 29/025 405/284
2009/0110491 A1 * 4/2009 Shaw ..... E02D 29/025 405/284
2012/0192522 A1 * 8/2012 Johnson ..... B28B 7/0061 52/606
2013/0034392 A1 * 2/2013 Ferraiolo ..... E02D 29/0241 405/284
2014/0248094 A1 * 9/2014 Walling ..... E02D 29/025 405/286
2015/0063924 A1 * 3/2015 Brookhart ..... E02D 29/0266 405/284
2016/0369472 A1 * 12/2016 Ianello ..... E02D 29/0266
2018/0051436 A1 * 2/2018 Smith ..... E02D 29/025

* cited by examiner

BUILDING BLOCK AND METHODS

This application is a National Stage Application of PCT/US2016/057530, filed on Oct. 18, 2016 and which application is incorporated herein by reference. To the extent appropriate, a claim of priority is made to the above-disclosed application.

TECHNICAL FIELD

This disclosure relates to concrete building blocks. In particular, this disclosure relates to concrete building blocks usable for the construction of free-standing walls, retaining walls, garden walls, and columns. Methods for using these blocks are also described.

BACKGROUND

Modular concrete blocks can be used to build walls, including free-standing walls, retaining walls, and landscaping walls. These blocks can be used either by contractors or by individuals in the "do it yourself" market.

SUMMARY

In one aspect, a concrete building block is provided which includes a body having opposite first and second sides, opposite first and second end faces extending between the first and second sides, and opposite first and second bearing faces extending between the first and second sides and the first and second end faces. The first bearing face is an upper face in use and has a contact surface portion that is planar. The second bearing face has a contact surface portion that is planar and parallel to the first bearing face. The first side of the body has a center plane that is orthogonal to the first and second bearing faces, the center plane bisecting the first side between a first section and second section. The first section has a first section length and is angled inwardly at a first extension angle relative to a plane orthogonal to the center plane, the first section extending to the center plane in extension from the first side. The second section has a second section length and is angled inwardly at a second extension angle relative to a plane orthogonal to the center plane, the second section extending to the center plane in extension from the second side. The first end face has a first end face length and is angled at a third extension angle in a direction toward the second end face, as the first end face extends from the first section of the first side to the second side. The second end face has a second end face length and is angled at a fourth extension angle in a direction toward the first end face, as the second end face extends from the second section of the first side to the second side. The first section length, second section length, first end face length, and second end face length are the same. The first, second, third, and fourth extension angles are the same.

In one embodiment, the second side of the body includes a first segment and a second segment with an inset between the first segment and second segment. The inset includes an inset wall extending between the first and second bearing faces. The first segment has a first segment length extending between the first end face and the inset wall. The second segment has a second segment length extending between the second end face and the inset wall. At least a portion of the inset wall is closer to the first side of the body than each of the first segment and second segment.

In one or more embodiments, the first segment and second segment of the second side are contained within a plane perpendicular to the center plane.

In some implementations, the first segment length and second segment length are the same.

In some embodiments, the center plane bisects the inset.

The inset wall may include a first inset wall extending from the first segment toward the first side; a second inset wall extending from the second segment toward the first side; and a third inset wall extending between the first and second inset walls.

In some arrangements, the first, second, third, and fourth extension angles are a non-zero angle less than 20 degrees.

In some arrangements, the first, second, third, and fourth extension angles are 6-12 degrees.

The first inset wall and the second inset wall may have the same length.

The first inset wall can be at a right angle relative to the third inset wall, and the second inset wall can be at a right angle relative to the third inset wall.

In some arrangements, the body includes a through core from the first bearing face to the second bearing face. The first bearing face includes first and second lugs projecting therefrom, the first and second lugs fitting into a respective core of two like blocks stacked with the two like block second bearing faces against the first bearing face.

In some implementations, the through core has a circular cross-section. The first and second lugs have semi-circular cross-sections.

In one or more arrangements, the first and second lugs are adjacent the second side.

In some arrangements, the through core has a cross-section in a shape of a regular polygon, and the first and second lugs each has a shape that can both be received together by the through core.

In some arrangements, the second side of the body includes a first segment and a second segment with an inset between the first segment and second segment. The first lug is adjacent the first segment, and the second lug is adjacent the second segment.

In one or more embodiments, the through core is bisected by the center plane and has a circular cross-section. The first and second lugs have semi-circular cross-sections.

In some implementations, a wall is provided including a plurality of blocks as characterized above in multiple courses.

The wall can be a free-standing wall and can include each course having a plurality of block pairs, with each block pair including a first block member and second block member with the first and second segments opposing and against each other. Adjacent block pairs are arranged such that the first side of one of the members of the block pair is opposing and against the end faces of first and second block members of the adjacent block pair.

The free-standing wall can include each of the blocks having a through core from the first bearing face to the second bearing face; the first bearing face including a pair of lugs projecting therefrom; and each course includes the through core of the blocks receiving lugs from blocks in a preceding lower course.

The free-standing wall can include the through core having a circular cross-section, and the first and second lugs having semi-circular cross-sections.

In other arrangements, the free-standing wall can include the through core having a cross-section in a shape of a regular polygon, and first and second lugs each having a shape that can both be received together by the through core.

In some implementations, the wall can be a retaining wall and include each of the blocks having a first lug projecting from the first bearing face and being adjacent the first segment, and a second lug projecting from the first bearing face and adjacent the second segment. Each course can have the second bearing face stacked on the first bearing face of the previous course, and the first and second lugs against the second side of blocks on the previous course.

In another aspect, a column is provided. The column includes a plurality of blocks as characterized above arranged in multiple courses. Each course may comprise a block pair, each block pair including a first block member and second block member with the first and second segments opposing and against each other. Each subsequent course may have the second bearing face of the first and second block members of the block pair stacked on the first bearing faces of the previous course and oriented 90 degrees relative to the previous course so that the first sides of the block pair in the subsequent course are over the end faces of the previous course.

The column may include each of the blocks having a through core from the first bearing face to the second bearing face. The first bearing face can include a pair of lugs projecting therefrom. Each course can include the through core of the blocks receiving lugs from the blocks in a preceding lower course.

The column may include the blocks having a through core with a circular cross-section, and first and second lugs having semi-circular cross-sections.

In another aspect, a concrete building block is provided including a body having opposite first and second sides, opposite first and second end faces extending between the first and second sides, and opposite first and second bearing faces extending between the first and second sides and the first and second end faces; the first bearing face being an upper face in use and having a contact surface portion that is planar; the second bearing face having a contact surface portion that is planar and parallel to the contact surface portion of the first bearing face; the first side of the body having a center plane that is orthogonal to the first and second bearing faces, the center plane bisecting the first side between a first section and second section; the first section and first end face are shaped to mate with each other when a like block is rotated 90° and oriented adjacent thereto so that the center plane for the two blocks are perpendicular to each other; and the second section and second end face are shaped to mate with each other when a like block is rotated 90° and oriented adjacent thereto so that the center plane for the two blocks are perpendicular to each other.

Methods of use and construction are provided herein.

DETAILED DESCRIPTION

Figure 1:
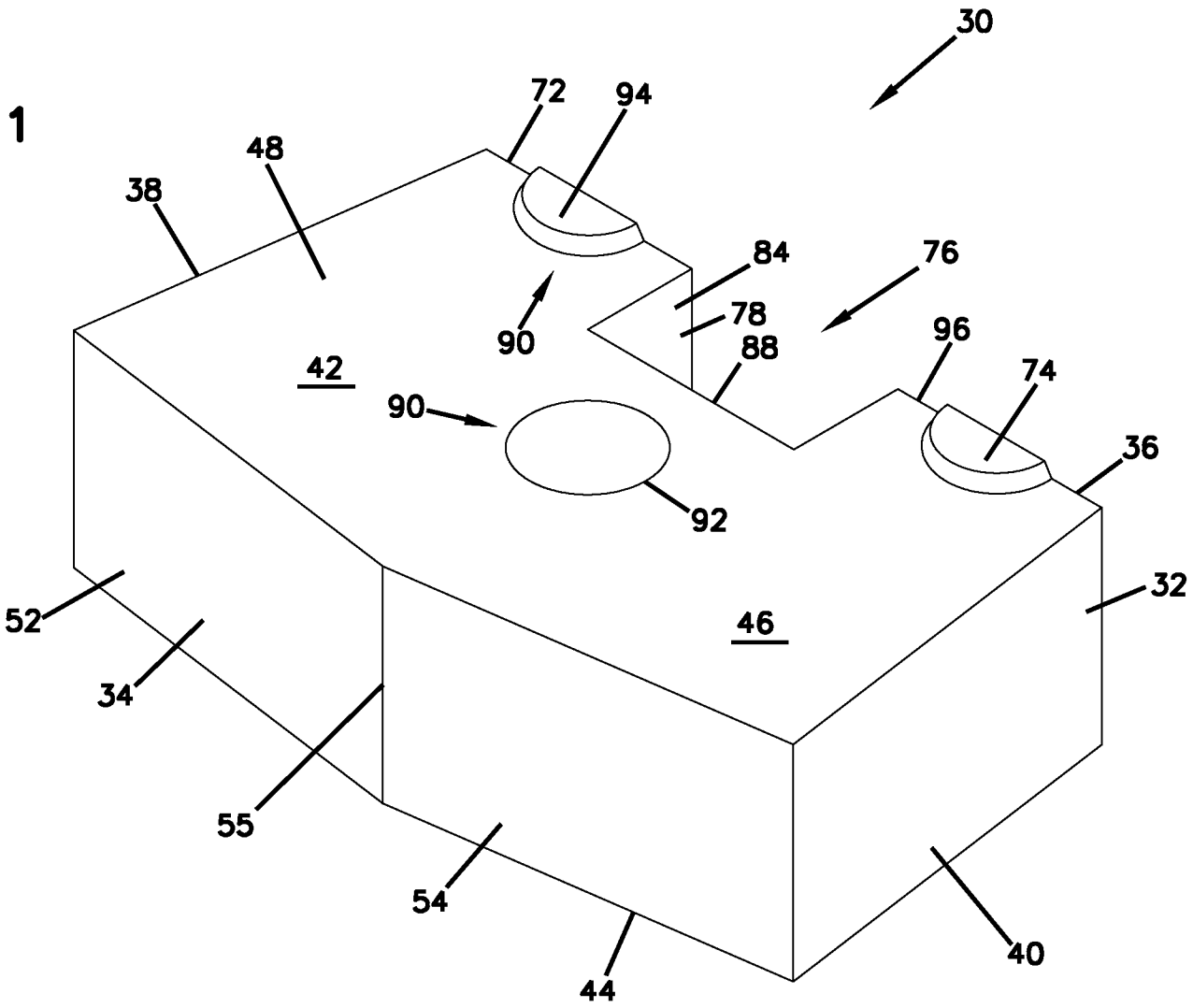
FIG. 1 is a perspective view of a first embodiment of a concrete building block, constructed in accordance with principles of this disclosure.

Embodiments of a building block constructed in accordance with the present invention are illustrated in FIGS. 1, 20, 33, and 35 at reference numeral 30. The building block 30 is preferably made of concrete, for example, dry cast concrete. The block 30 includes a body 32. The body 32 has a first side 34 and an opposite second side 36. When the block 30 is used as a retaining wall block, the first side 34 will be the side that is visible and exposed. When the block 30 is used as part of a free-standing wall, the first side 34 will be one of the sides that is visible and exposed.

The body 32 includes a first end face 38 and an opposite second end face 40. The first and second end faces 38, 40 extend between the first and second sides 34, 36. When the body 32 is used as a free-standing wall, the first and second end faces 38, 40 are faces, in addition to the first side 34, that can be visible.

Figure 3:
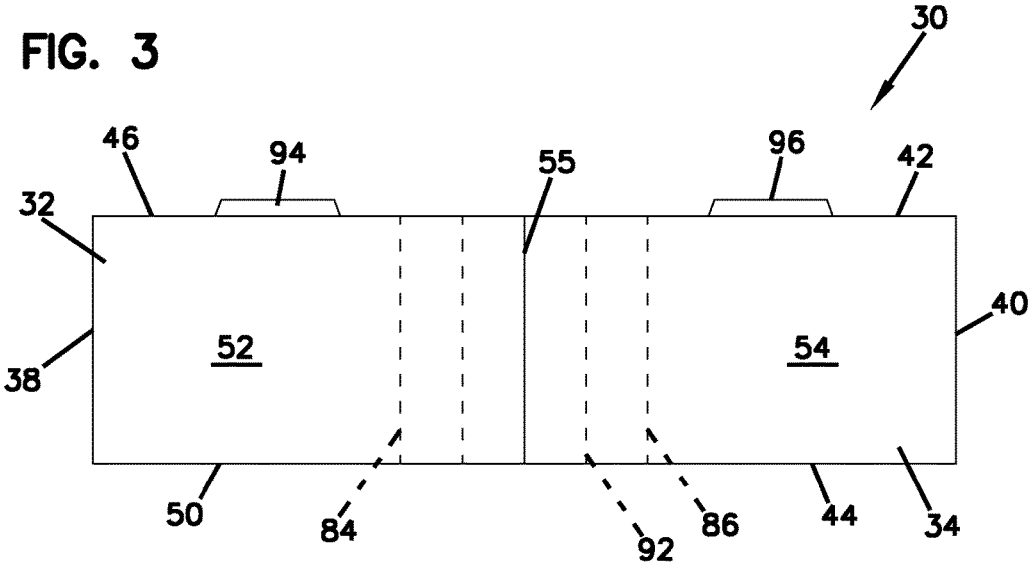
FIG. 3 is a front view of the block of FIG. 1.
Figure 4:
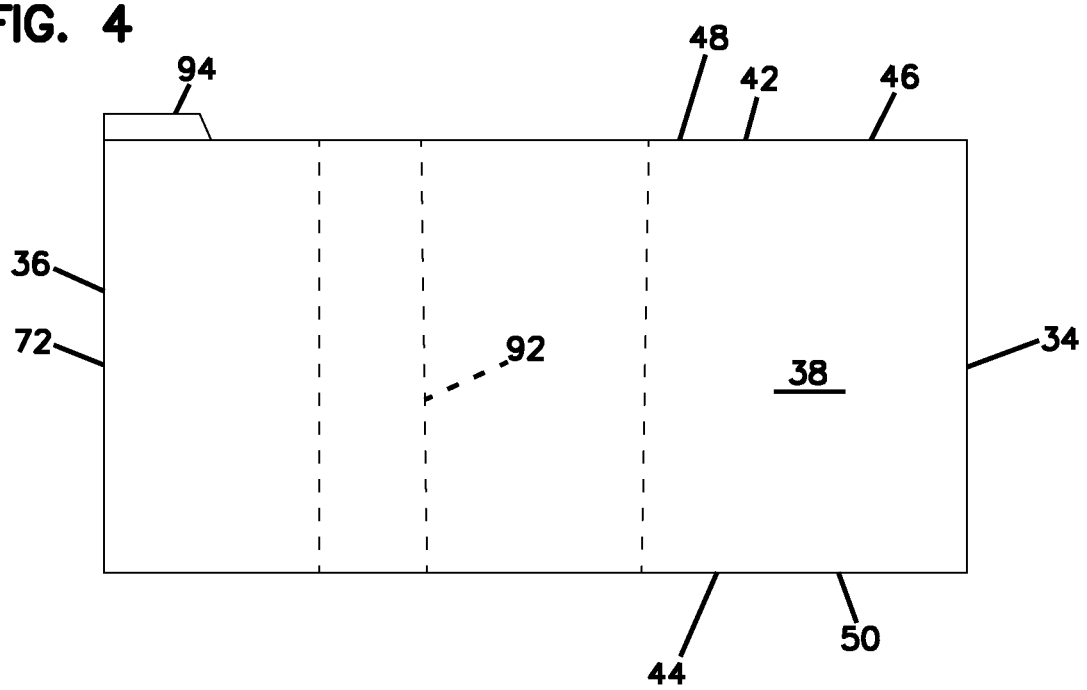
FIG. 4 is a side view of the block of FIG. 1.
Figure 5:
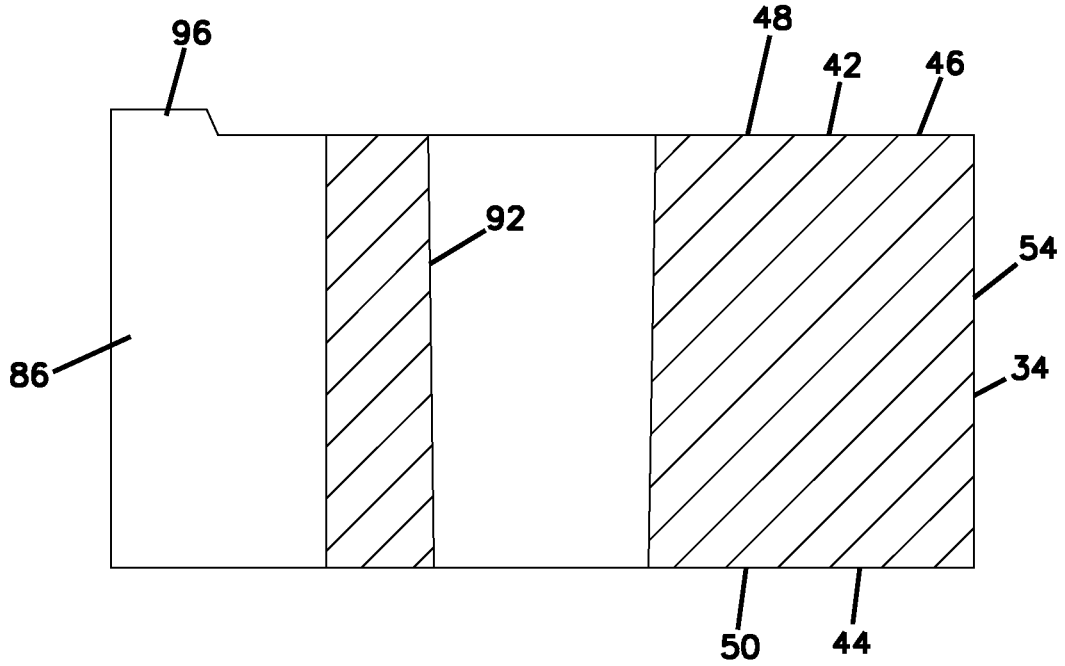
FIG. 5 is a cross-sectional view of the block of FIG. 1, the cross-section being taken along the line 5-5 of FIG. 2.
Figure 20:
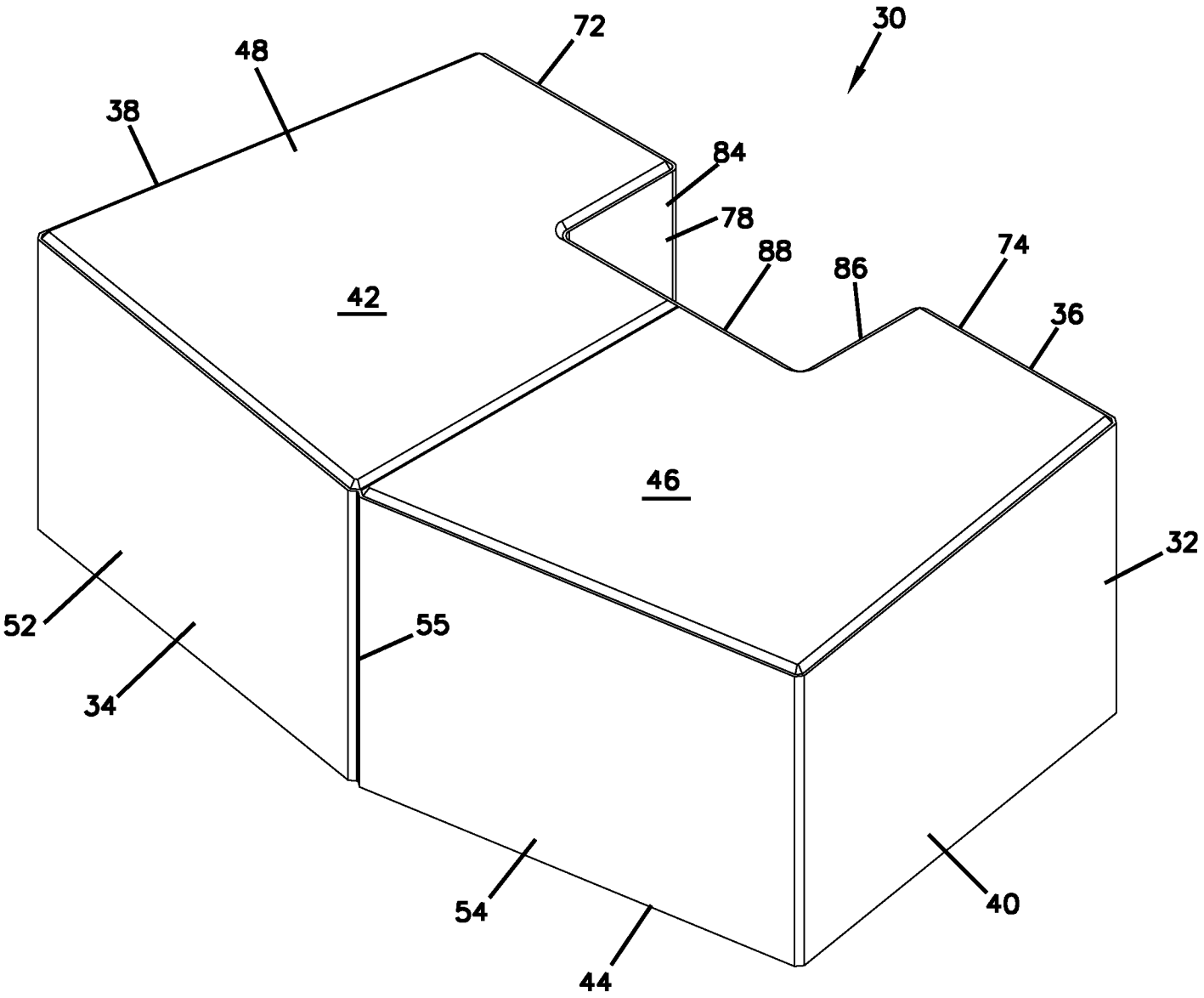
FIG. 20 is a perspective view of another embodiment of a concrete building block, constructed in accordance with principles of this disclosure.
Figure 21:
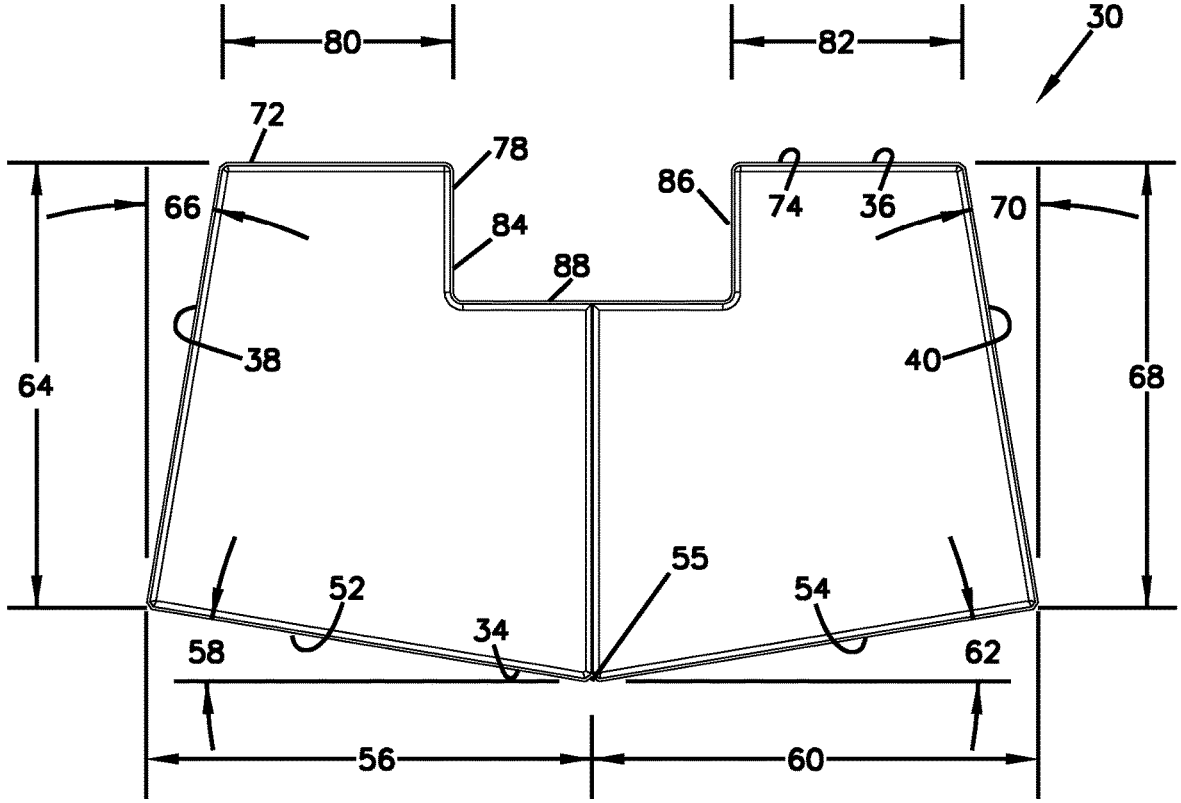
FIG. 21 is a top view of the block of FIG. 20.
Figure 22:
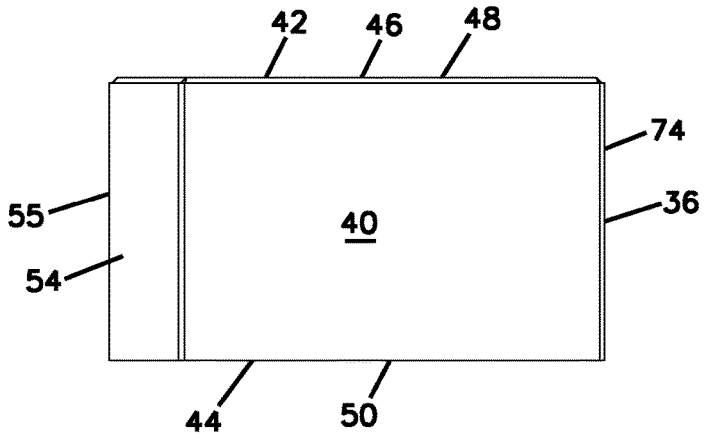
FIG. 22 is a side view of the block of FIG. 20.

The body 32 includes a first bearing face 42 and an opposite second bearing face 44. The first and second bearing faces 42, 44 extend between the first and second sides 34, 36 and the first and second end faces 38, 40. The first bearing face 42, as illustrated in FIGS. 1 and 20, is an upper face 46 in use. The upper face 46 has a contact surface portion 48 that is planar or flat. The second bearing face 44 has a contact surface portion 50 (FIGS. 3 and 22) that is planar or flat and parallel to the contact surface portion 48 of the first bearing face 42.

Figure 2:
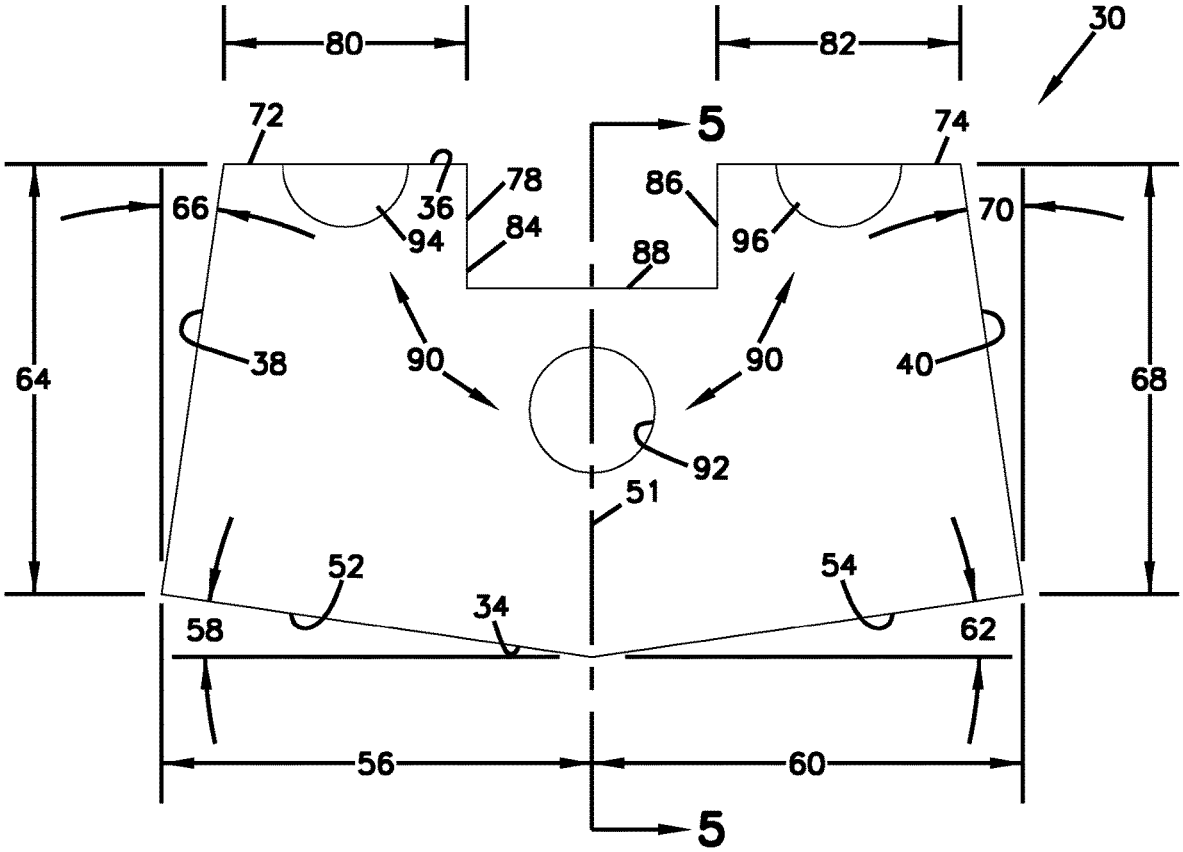
FIG. 2 is a top view of the block of FIG. 1.
Figure 35:
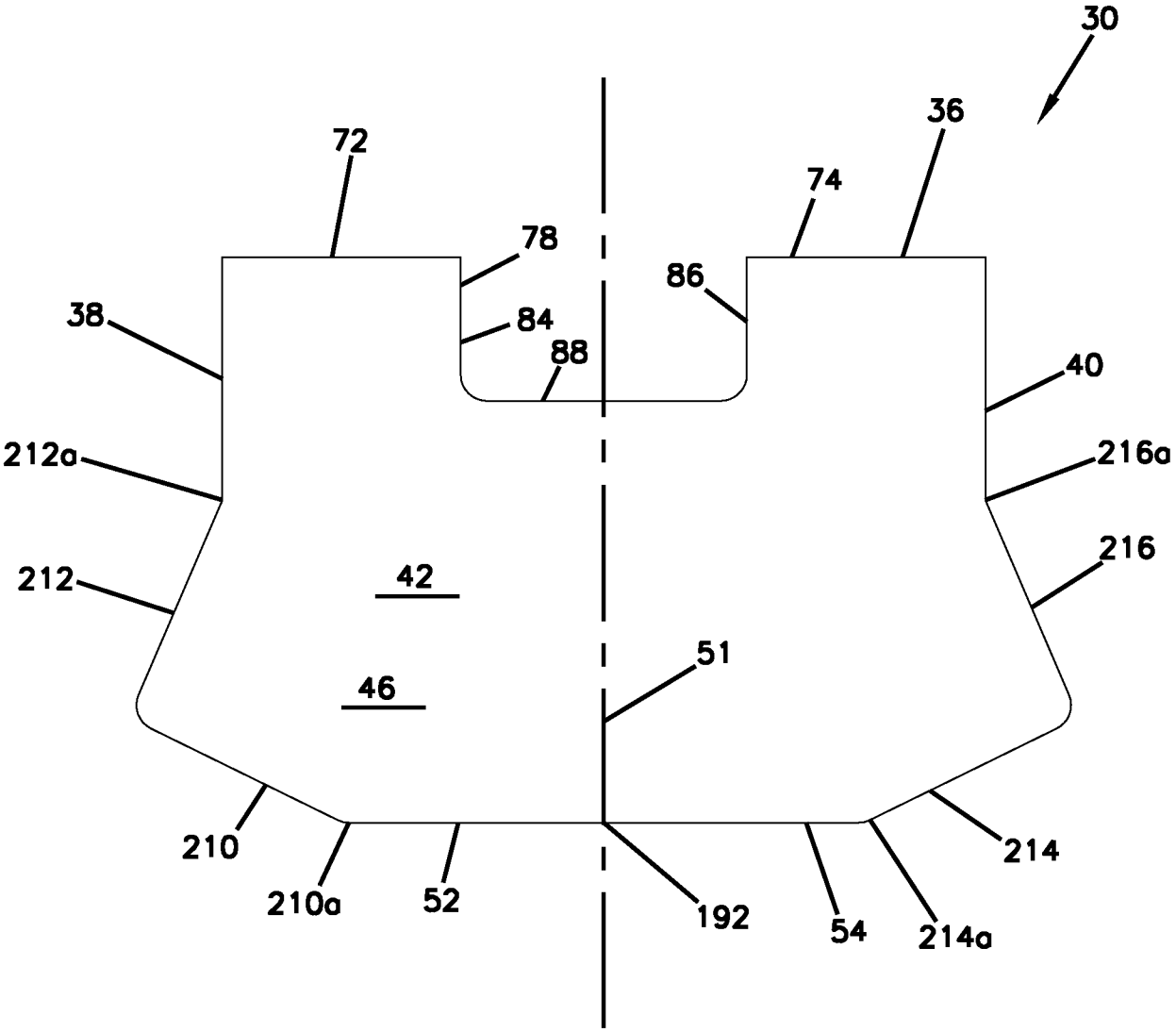
FIG. 35 is a top view of another embodiment of a concrete building block, constructed in accordance with principles of this disclosure.

FIG. 2 illustrates a top view of the block 30 of FIG. 1. A plane that is in alignment with the cross-sectional line 51 in FIG. 2 is orthogonal to the first and second bearing faces 42, 44. The plane is a center plane in that it bisects the first side 34 to divide the first side 34 between a first section 52 and a second section 54. In the example embodiment of FIG. 1 and FIG. 20, the first section 52 and second section 54 intersect at a peak 55, but many shapes are possible. For example, in the embodiment of FIG. 33, the first section 52 and second section 54 form a smooth, curved surface 190 at the center plane along the line 51. In the embodiment of FIG. 35, the first section 52 and second section 54 form a flat, planar surface 192 at the center plane along the line 51.

In general, the first section 52 and the first end face 38 are shaped to mate with each other or mateably engage, when a like block 30 is rotated 90° and oriented adjacent so that the center plane along line 51 for the two blocks 30 are perpendicular to each other. Similarly, the second section 54 and the second end face 40 are shaped to mate with each other or mateably engage, when a like block 30 is rotated 90° so that the center plane along line 51 for the two blocks 30 are perpendicular to each other. By "mate with each other," it is meant that the exterior surfaces of the first section 52 and first end face 38 closely contact each other. Similarly, the exterior surfaces of the second section 54 and second end face 40 closely contact each other. The mating engagement can be in many different forms, such as: straight surfaces that engage against each other (FIGS. 1 and 20); or projections and receivers (FIGS. 33 and 35), which can include concave and convex curved surfaces (FIG. 33), or outward and inward angled surfaces (FIG. 35).

In FIG. 2, the first section 52 is illustrated as having a first section length 52 as it extends between the center plane, represented by the cross-sectional line 51, to the first end face 38. The first section 52 is angled inwardly at a first extension angle 58 relative to a plane orthogonal to the center plane. The first section 52 is sloped or angled inwardly as it extends between the center line 51 and the first end face 38.

The second section 54 has a second section length 60. The second section length 60 extends between the center line 51 and the second end face 40. The second section 54 is angled inwardly at a second extension angle 62 relative to a plane orthogonal to the center plane. The second section 54 extends to the center plane and center line 51 in extension from the second end face 40. The second section 54 slopes toward the second side 36 as it extends from the center line 51 to the second end face 40.

The first end face 38 has a first end face length 64 as it extends between the first side 34 and second side 36. The first end face 38 is angled at a third extension angle 66 in a direction toward the second end face 40, as the first end face 38 extends from the first section 52 of the first side 34 to the second side 36.

Still in reference to FIG. 2, the second end face 40 has a second end face length 68 between the first side 34 and second side 36. The second end face 40 is angled at a fourth extension angle 70 in a direction toward the first end face 38, as the second end face 40 extends from the second section 54 of the first side 34 to the second side 36.

In preferred arrangements, the first section length 56, second section length 60, first end face length 64, and second end face length 68 are the same. By the term "the same", it is meant there can be differences due to tolerances, etc. Advantages for having these lengths the same is described further below.

In preferred embodiments, the first extension angle 58, second extension angle 62, third extension angle 66, and fourth extension angle 70 are the same. Advantages are achieved from having these angles the same, as described further below.

The second side 36 of the body 32 includes a first segment 72 and a second segment 74 with an inset 76 between the first segment 72 and second segment 74. The inset 76 includes an inset wall 78 extending between the first and second bearing faces 42, 44. The first segment 72 has a first segment length 80 extending between the first end face 38 and the inset wall 78. The second segment 74 has a second segment length 82 extending between the second end face 40 and the inset wall 78. At least a portion of the inset wall 78 is closer to the first side 34 of the body 32 than each of the first segment 72 and second segment 74 is to the first side 34 of the body 32.

Many different embodiments for the shape of the second side 36 are possible. In the example illustrated, the first segment 72 and the second segment 74 of the second side 36 are contained within a plane perpendicular to the center plane. The plane that contains the first segment 72 and second segment 74 is perpendicular to the center line 51, which is contained within the center plane.

In preferred embodiments, the first segment length 80 and the second segment length 82 are the same. As can be seen in FIG. 2, the center plane, which contains the center line 51, bisects the inset 76. Preferably, the inset wall 78 includes a first inset wall 84 extending from the first segment 72 toward the first side 34. The inset wall 78 further includes a second inset wall 86 extending from the second segment 74 toward the first side 34. The inset wall 78 further includes a third inset wall 88 extending between the first inset wall 84 and second inset wall 86. While many different shapes are possible, in the example illustrated, the inset 76, defined by the first inset wall 84, second inset wall 86, and third inset wall 88, has a rectangular shape. As such, the first inset wall 84 and second inset wall 86 have the same length. The first inset wall 84 is at a right angle relative to the third inset wall 88, and the second inset wall 86 is at a right angle relative to the third inset wall 88.

The first extension angle 58, second extension angle 62, third extension angle 66, and fourth extension angle 70 may have a variety of values. In many useful embodiments, these angles are a non-zero angle less than 20 degrees. In some examples, these angles range from 6-12 degrees. In one example embodiment, the angle is about 9-10 degrees. Many other embodiments are possible.

In the embodiment of FIG. 20, both the first bearing face 42 and second bearing face 44 are flat, and are projection-free, in that they lack having any lugs or positioning members thereon. This differs from the embodiment of FIG. 1, which includes a positioning arrangement 90.

In reference now to the embodiment of FIGS. 1-5, the body 32 includes a through core 92 extending from the first bearing face 42 to the second bearing face 44, which forms a first member of the positioning arrangement 90.

Figure 9:
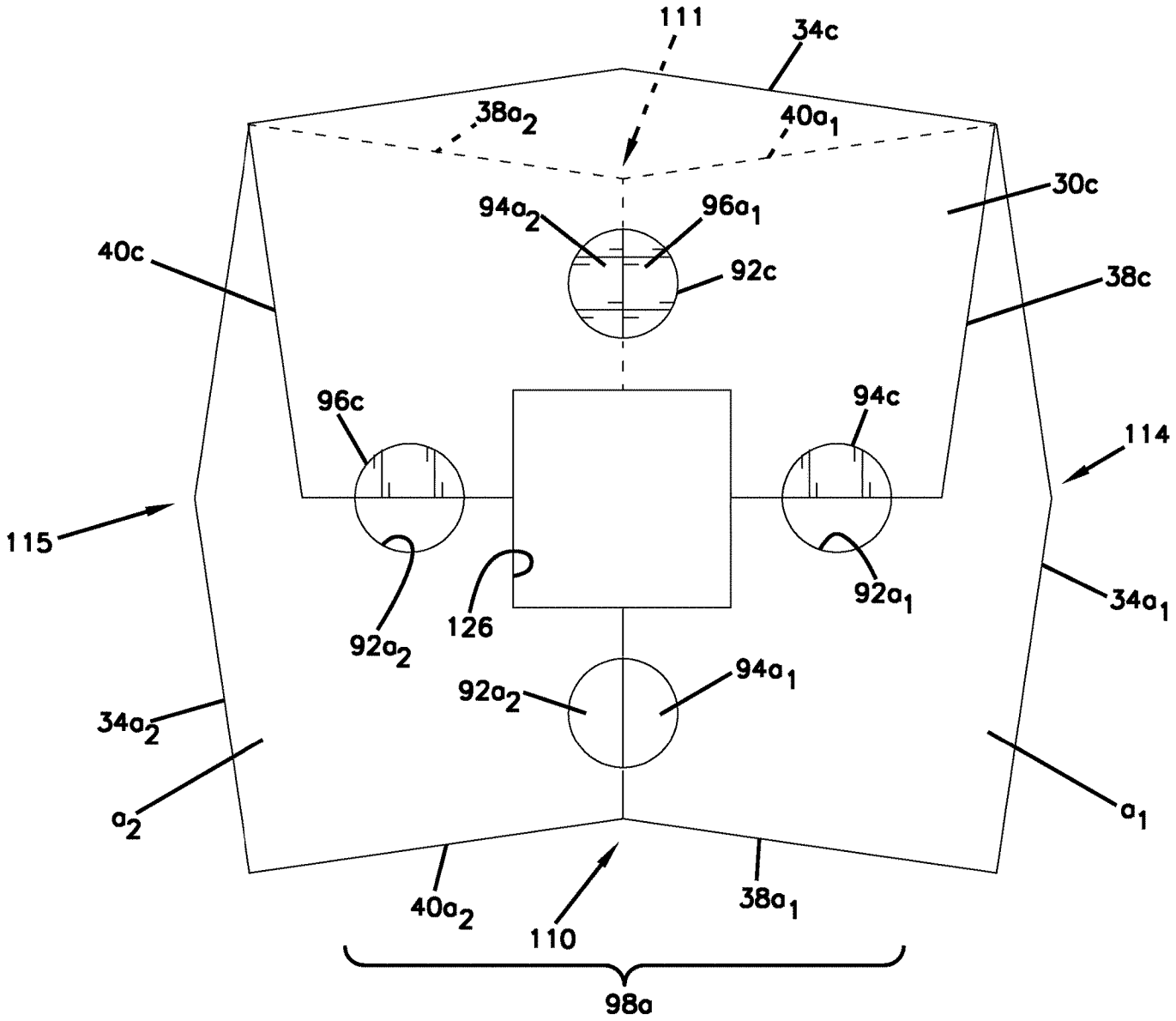
FIG. 9 is a top view of a step of using the blocks of FIG. 1 in multiple courses.

The first bearing face 42 includes a first lug 94 and a second lug 96 projecting therefrom, which forms a second member of the positioning arrangement 90. The first and second lugs 94, 96 fit into a respective core 92 of two like blocks 30 stacked with the two like blocks second bearing faces 44 against the first bearing face 42. See FIG. 9. In FIG. 9, there is a block pair 98*a* including a first block a1 and a second block a2. The first block a1 and second block a2 have the features of block 30 of FIG. 1. The block pair 98*a* is arranged such that the first block a1 and second block a2 are engaged against each other along the second side 36, and the lugs 94*a*1, 96*a*2 and 96*a*1, 94*a*2 are also against each other. Then the third block 30*c* is placed on the first bearing face 42 of the block pair 98*a*. The third block 30*c* is oriented 90 degrees relative to the first block a1 and second block a2. The third block 30*c* has its center core 92*c* lined up such that it receives the lugs 94*a*2, 96*a*1 of the block pair 98*a*. Also visible in FIG. 9 is half of the center core 92*a*1 of the first block a1 and half of the center core 92*a*2 of the second block a2. The aligned lugs 94*a*1, 96*a*2 at the portion of the block pair 98*a* that is not covered by the third block 30*c* is aligned and ready to receive the core 92 of another block that will be stacked onto the first bearing faces 42 of the first block a1 and second block a2 with the second side 36 engaged against the second side 36 of the third block 30*c*.

It should be understood that the through core 92 can have many different shapes. For example, the through core 92 can have a cross-section in the shape of a regular polygon. In the examples illustrated, the through core has a circular cross-section. In this embodiment, the through core 82 is also bisected by the center plane and the center line 51.

It should be understood that in other embodiments, the core 92 can be in open communication with the inset 76. That is, in other arrangements, there will not be block material separating the core 92 from the inset walls 88, 86, 84. The core 92 would be connected to the inset 76.

The first and second lugs 94, 96 can be any shape that, when two of them are together from adjacent blocks, can both be received together by the through core 92. This can include, for example, lugs that are triangle shaped, forming a diamond shape when together, or plus-shaped, or just be a series or plurality of projections. In the examples illustrated, the first and second lugs 94, 96 have a semi-circular cross-section. As such, when the first and second lugs 94, 96 of two adjacent blocks are placed together with their second sides 36 engaged against each other, the first and second lugs 94, 96 of adjacent blocks form a cylinder, having a circle shape in top view.

The first and second lugs 94, 96 are preferably adjacent the second side 36. In preferred arrangements, the first lug 94 is adjacent the first segment 72, and the second lug 96 is adjacent the second segment 74.

In reference again to FIG. 6, the block 30, when positioned adjacent a like block 30 so that the first and second segments 72, 74 along the second side 36 are opposed and against each other, form block pair 98. The block pair 98 comprises two identical blocks 30, one being a first block member 30*a* and the other being second block member 30*b*. The block pair 98 (as one unit) can fit within a receiver 110 of an adjacent block pair 98, by being rotated 90 degrees relative to the adjacent block pair.

Figure 6:
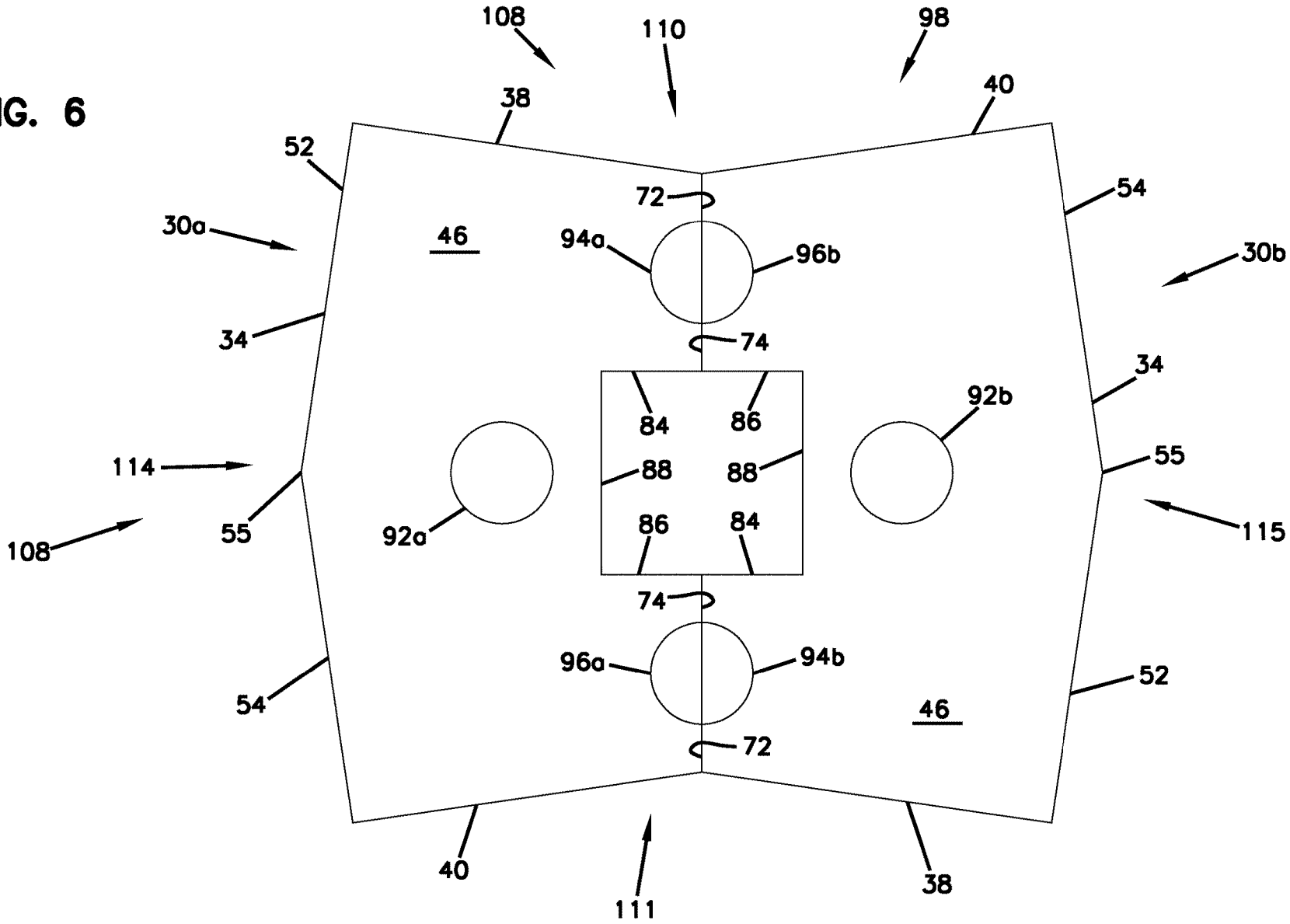
FIG. 6 is a top view of a block pair, showing two of the blocks of FIG. 1 in one step of use.

The block pair 98 includes a projection/receiver arrangement 108 for engagement with an adjacent block pair 98. In FIG. 6, the receiver 110 is formed by the first end face 38 of block 30*a* and the second end face 40 of block 30*b*.

The block pair 98 includes a second receiver 111 formed by the second end face 40 of the block 30*a* and the first end face 38 formed by the block 30*b*. In FIG. 6, it can be seen how the receivers 110, 111 are on opposite sides of the block pair 98.

The other half of the projection/receiver arrangement 108 includes projection 114 formed by the first side 34 of the block 30*a*. The block 30*b* also has projection 115 formed by first side 34. Each of the projections 114, 115 can mate and be received by receivers 110, 111 of an adjacent block pair 98. This is described further below.

Figure 7:
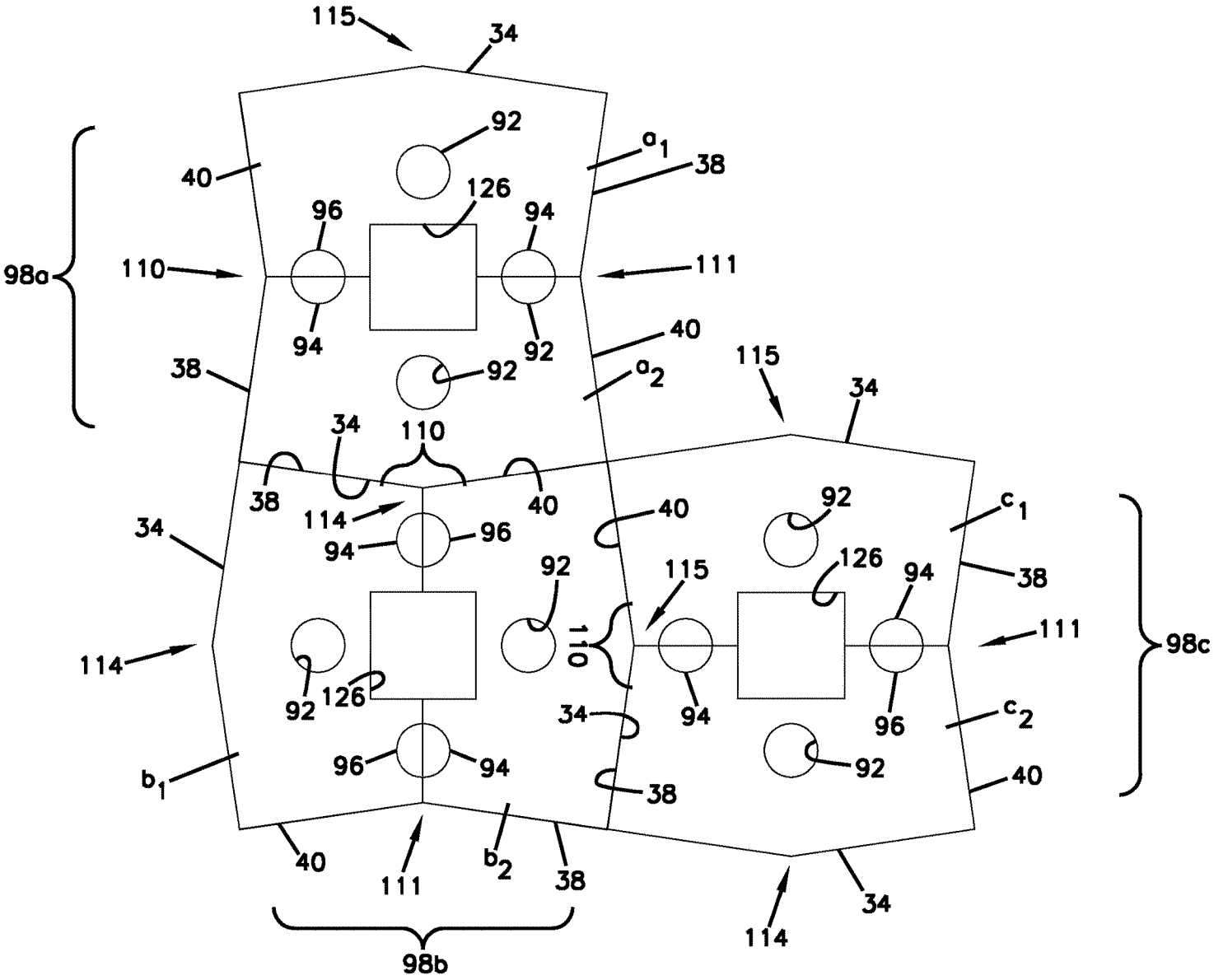
FIG. 7 is a top view showing three block pairs of FIG. 6 in one step of use.

FIG. 7 illustrates how adjacent block pairs 98 are arranged such that one of the projections 114, 115 is opposing and against and received by one of the receivers 110, 111 of the adjacent block pair 98. In particular, in FIG. 7, there are three block pairs 98*a*, 98*b*, and 98*c* illustrated. The block pair 98*a* is made up of first and second block members a1 and a2. The block pair 98*b* is made up of block members b1 and b2. Block pair 98*c* is made up of block members c1 and c2. Adjacent block pairs 98*b* and 98*c* are arranged such that the first side 34 of block member b2 is opposing and against the end faces 38, 40 of the first and second block members c1, c2 of the adjacent block pair 98*c*. Similarly, the first side 34 of block a2 is opposing and against the end faces 38, 40 of the first and second block members b1, b2 of block pair 98*b*.

Figure 8:
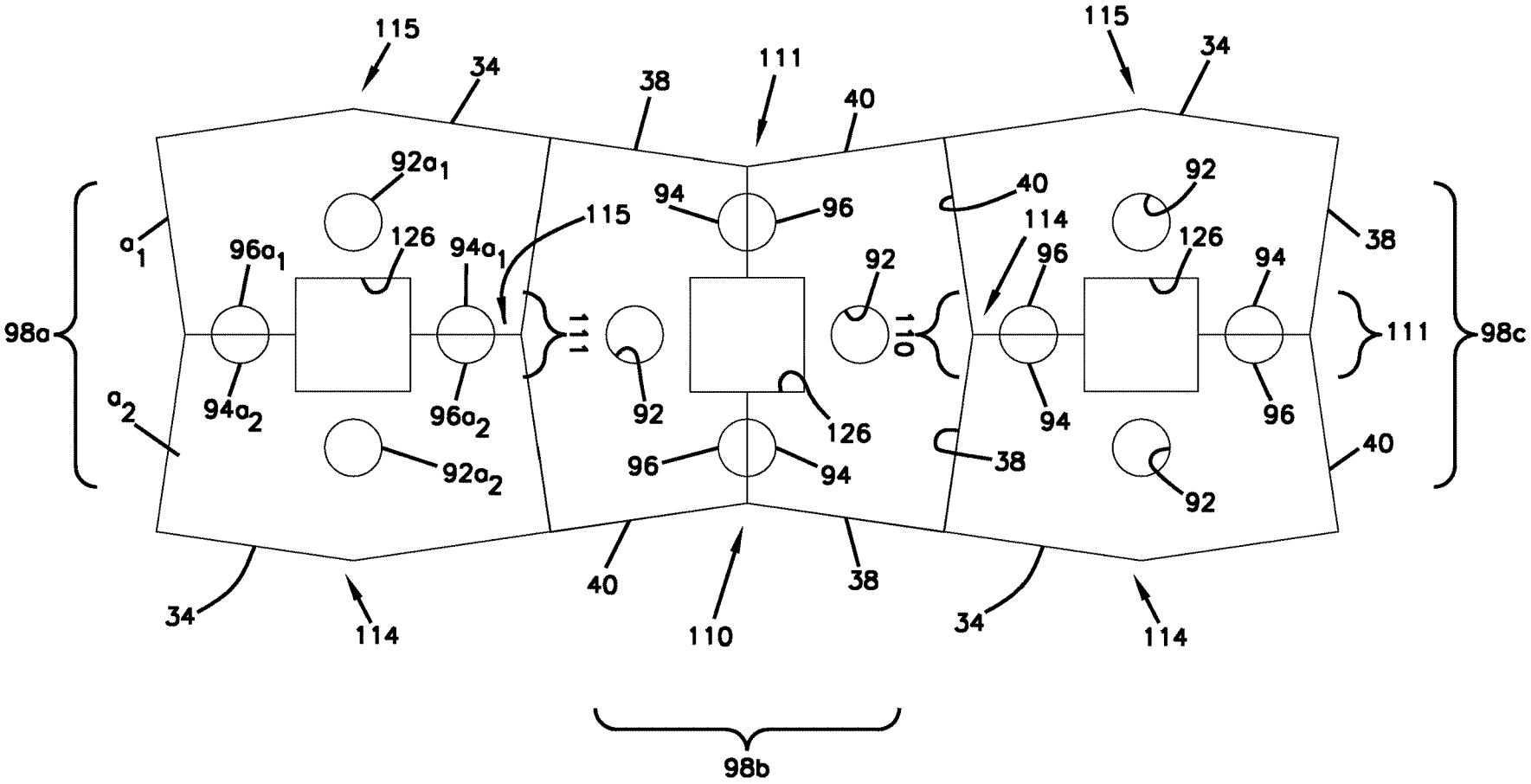
FIG. 8 is a top view of three block pairs in one step of use.
Figure 13:
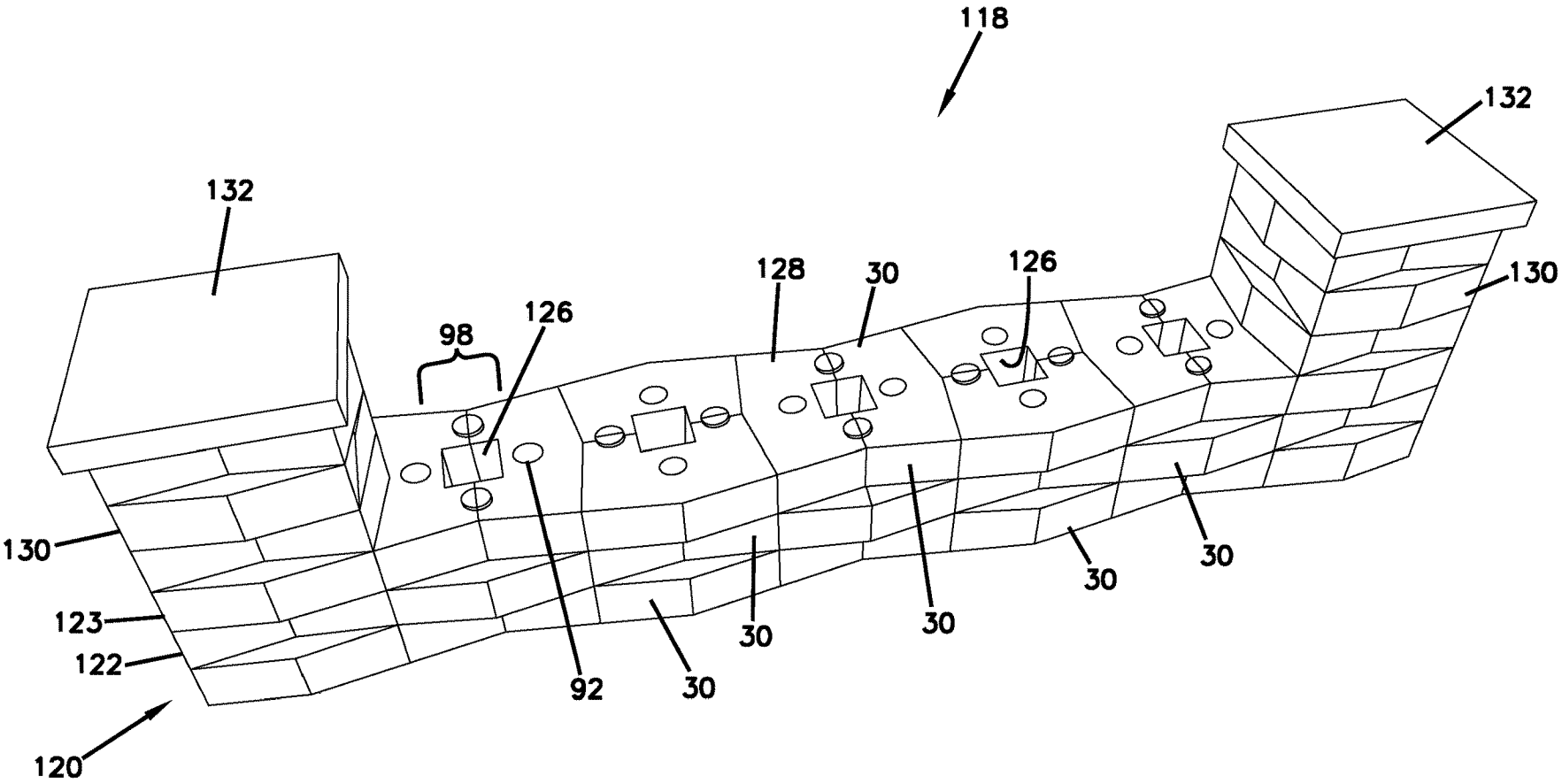
FIG. 13 is a perspective view of a free-standing wall constructed from the block of FIG. 1.

While FIG. 7 illustrates the block pairs 98 forming a corner, FIG. 8 illustrates the block pairs 98*a*, 98*b*, 98*c* arranged in a row. The block pairs 98 of FIG. 7 and FIG. 8 can formed a portion of a free standing wall 118 (FIG. 13). For example, FIG. 8 can form the first course 120 of the free standing wall 118. The free standing wall 118 is formed from multiple courses, an example being illustrated as course 122 and 123 in FIG. 13. The features of the block of FIG. 1 can be used to help construct the free standing wall 118, as described below.

Referring to FIG. 8, each of the block pairs 98*a*, 98*b*, 98*c* is arranged adjacent and against another block pair 98, so that projections 114, 115 are nested in receivers 110, 111, and with each block 30 including the through core 92 that extends through and from the first bearing face 42 to the second bearing face 44. The first bearing face 42 also includes the lugs 94, 96 projecting therefrom. Block pair 98*a* includes block member a1 with core 92*a*1 and first and second lugs 94*a*1, 96*a*1; and block member a2 with core 92*a*2 and first and second lugs 94*a*2, 96*a*2.

The shape of the block pairs 98, including the projection/receiver arrangement 108 is advantageous in that when adjacent block pairs 98 are lined up next to each other, with the projections and receivers in mating engagement, there is a resistance to forces that would push the blocks 30 laterally out of alignment, or out of a wall when the block pairs 98 are part of a wall.

FIG. 9 shows a block 30*c* stacked on top of block pair 98*a*. The block 30*c* will be the start of another course, such as course 122. Block 30*c* includes through core 92*c* which receives lugs 94*a*2, 96*a*1 from the block pair 98*a*. The block 30*c* is resting on the first bearing face 42 of the block pair 98*a*, and the block 30*c* has its first bearing face 42 facing away from the block pair 98*a* with the lugs 96*c* and 94*c* also facing upward and away from the block pair 98*a*. Block 30*c* will form half of a block pair 98*d*, illustrated in FIG. 10.

Figure 10:
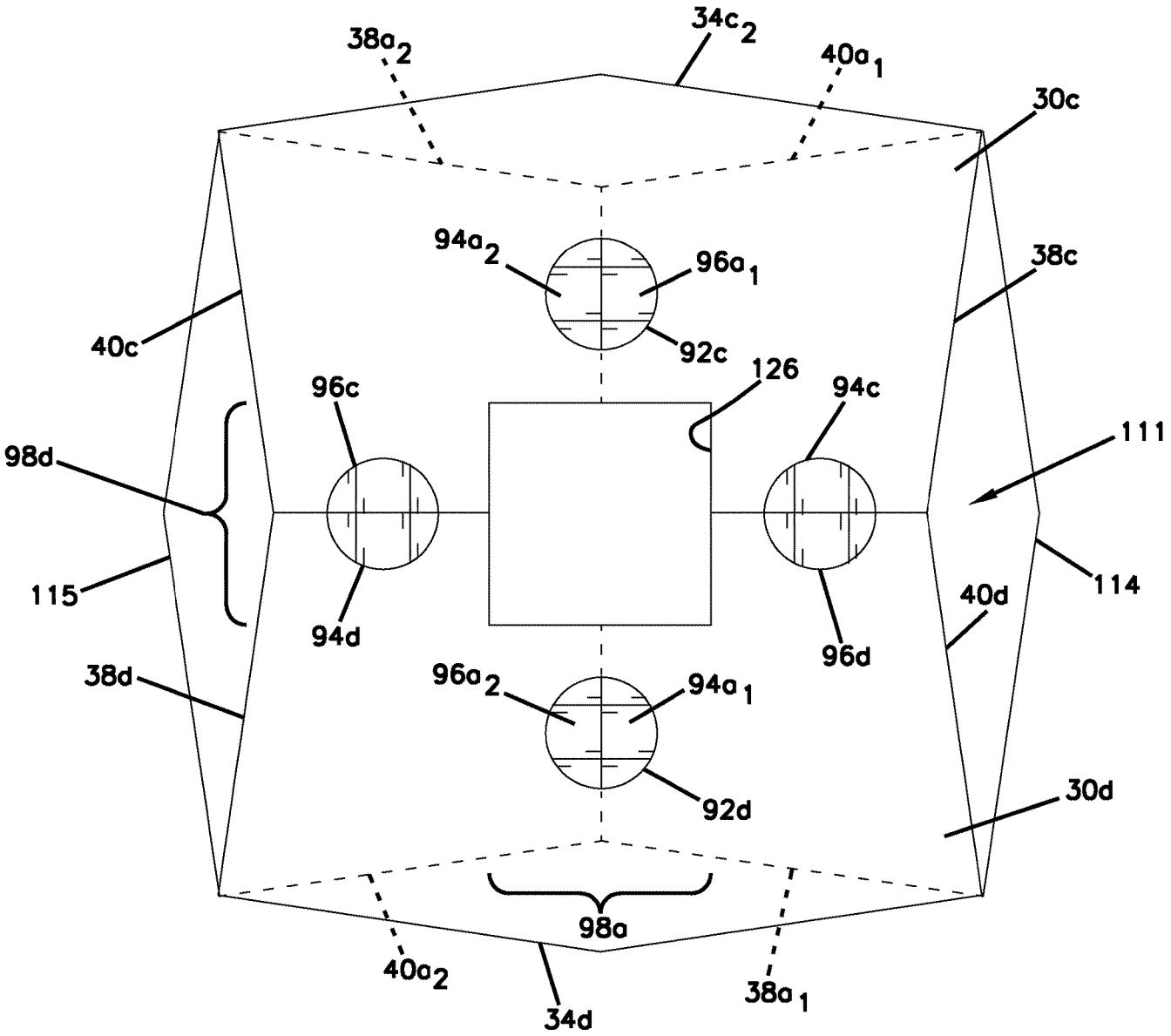
FIG. 10 is a top view of one block pair of FIG. 6 stacked on top of another block pair of FIG. 6.

FIG. 10 shows another block 30*d* stacked on top of block 98*a* of FIG. 9. The block 30*d* forms one member of block pair 98*d* (comprising blocks 30*c* and 30*d*), which forms the second course on top of block pair 98*a*. The block 30*d* is stacked on block pair 98*a* such that the second bearing face 44 of the block 30*d* is against the first bearing faces 42 of the block pair 98*a*. When this is done, the through core 92*d* receives the projecting lugs 96*a*2 and 94*a*1 of the first block pair 98*a*. The projecting lugs 96*c*, 94*d* and 94*c*, 96*d* are oriented to receive the through core 92 of another block pair 98 that would be stacked on top of block pair 98*d* to form a third course.

Figure 29:
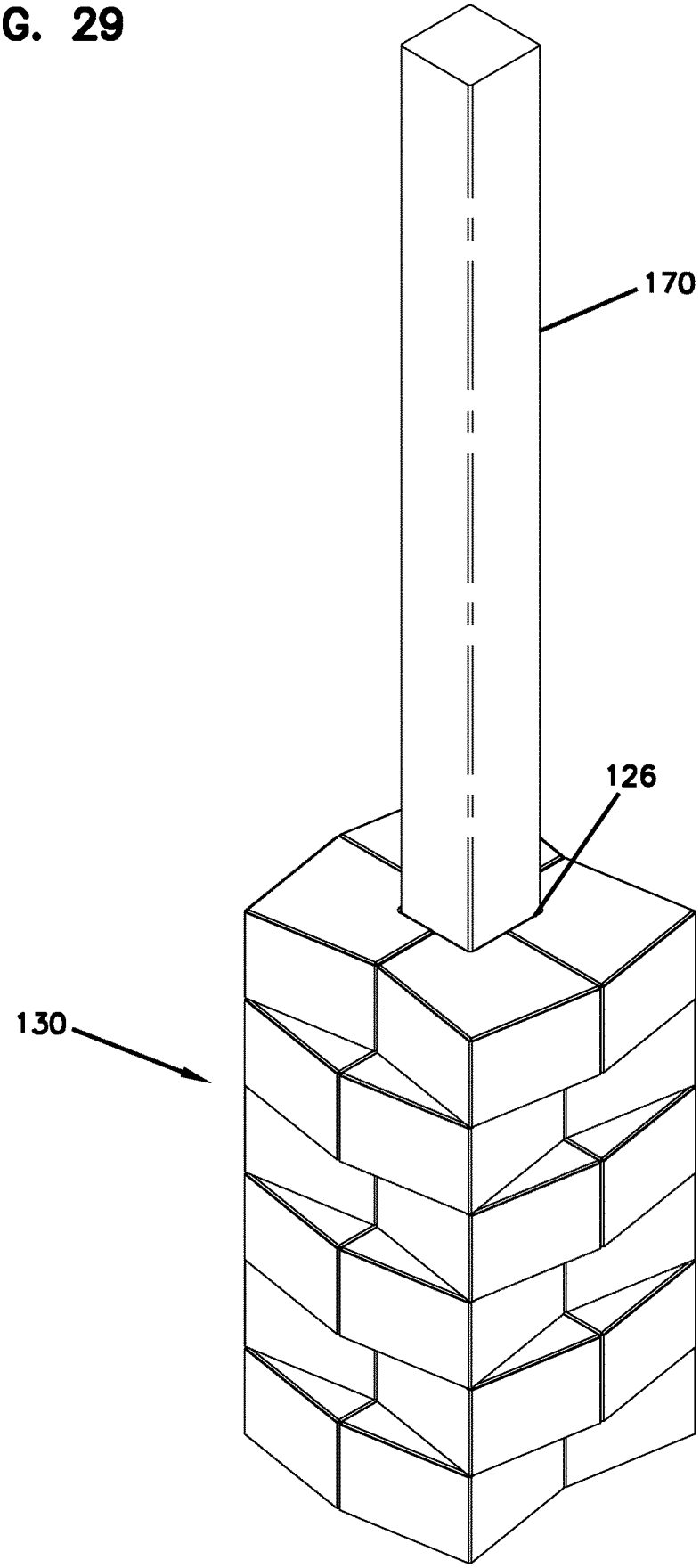
FIG. 29 is a perspective view of a column formed by the blocks of FIG. 1 or 20 around a post.

As can also be appreciated from reviewing FIGS. 9 and 10, the insets 76 are aligned in adjacent courses to form a center core 126 through the multiple courses. The center core 126 is illustrated as being rectangular, and in some cases, square. This can be used to form columns or other structures around a post 170 (FIG. 29), such as a fence post, a mail box post, a deck post or other vertically oriented structure. For example, a block pair 98 will fit around a 4 inch by 4 inch post, which can measure 3.5×3.5 inches. Block pairs 98 can be stacked to form a column 130 (see FIG. 13), in which the column 130 covers up the post. The blocks can be made in other dimensions and sizes so that the center core 126 size can change to accommodate whatever size of the post that is desired.

Figure 11:
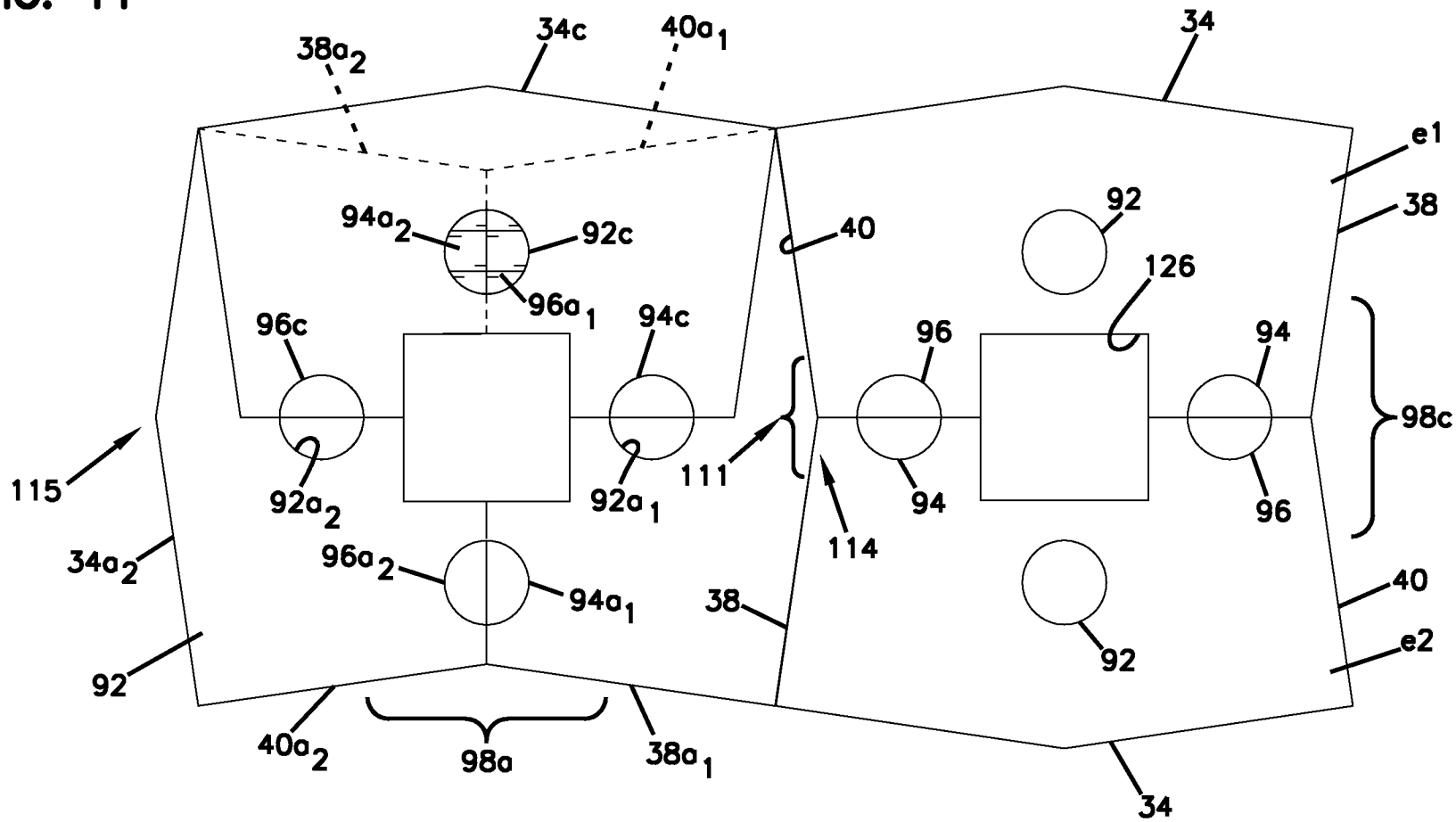
FIG. 11 is a top view showing another step of use of the block of FIG. 1.

FIG. 11 illustrates FIG. 9 with another block pair 98*e* adjacent and against the block pair 98*a* in the first course 120. The receiver 111 of the block pair 98*e* receives the projection 115 of the block pair 98*a*.

Figure 12:
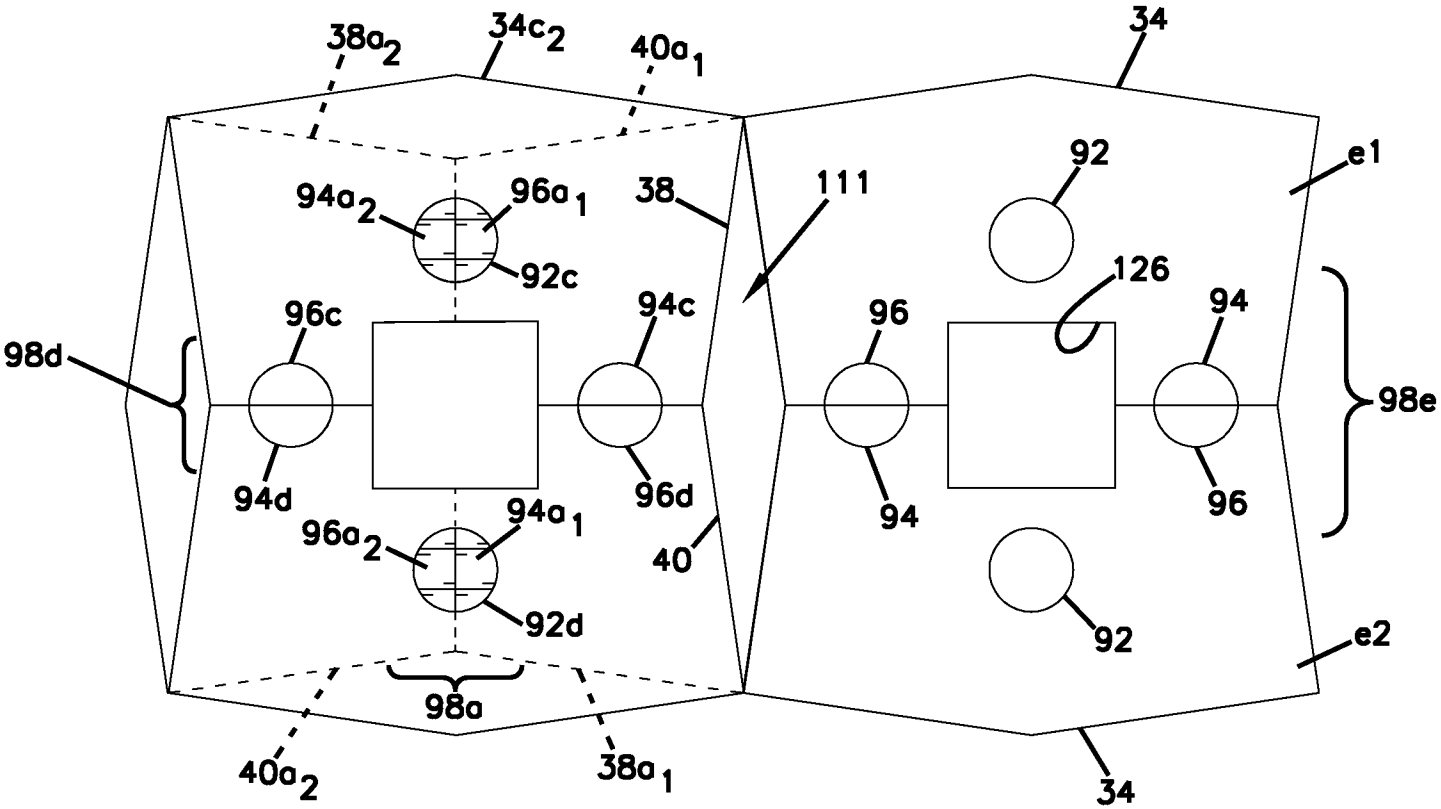
FIG. 12 is a top view showing another step of use of the block of FIG. 1.

FIG. 12 shows the construction of FIG. 10 with the block pair 98*e* adjacent and against the block pair 98*a*, as illustrates in FIG. 11. The block pair 98*d* is stacked on the block pair 98*a* (as described above in FIG. 10), and it has receiver 111 formed by adjacent end faces 38, 40 oriented to receive a projection 114 of another block 30 stacked on top of the block pair 98*e*.

FIG. 13 illustrates the free standing wall 118 formed by the blocks 30 of FIG. 1. The free standing wall 118 includes the first or base course 120, with the second course 122 stacked on top of it, followed by the third course 123 stacked on top of the second course 122. The center core 126 can be seen along a top 128 of the free standing wall 118.

The block 30 can be used to form columns 130, which are shown at each end of the free standing wall 118. Column 130 is formed by stacking block pairs 98 on top of each other oriented at 90 degrees. In particular, after the initial pair 98 forms the first course, each subsequent course has the second bearing face 44 of the block pair 98 stacked on the first bearing faces 42 of the previous course and oriented 90 degrees relative to the previous course so that the first sides 34 of the block pair 98 in the subsequent course are over the end faces 38, 40 of the previous course. When using the block 30 of FIG. 1, each course in the column 130 will include the through core 92 to receive lugs 94, 96 from the block pair 98 in a preceding lower course. FIG. 10 is an example of the first two courses of column 130.

In FIG. 13, the columns 130 are capped with a decorative cap block 132. FIG. 13 illustrates when the wall 118 is built with the lugs 94, 96 facing upwardly. In that case, in the top course, the lugs 94, 96 could be removed (knocked off). Or, the top course can be made with the lugs facing downwardly toward the preceding course. Alternatively, the wall 118 could be built with the first bearing face 42 having lugs 94, 96 facing downwardly, in which case, the lugs 94, 96 would not need to be removed.

Figure 14:
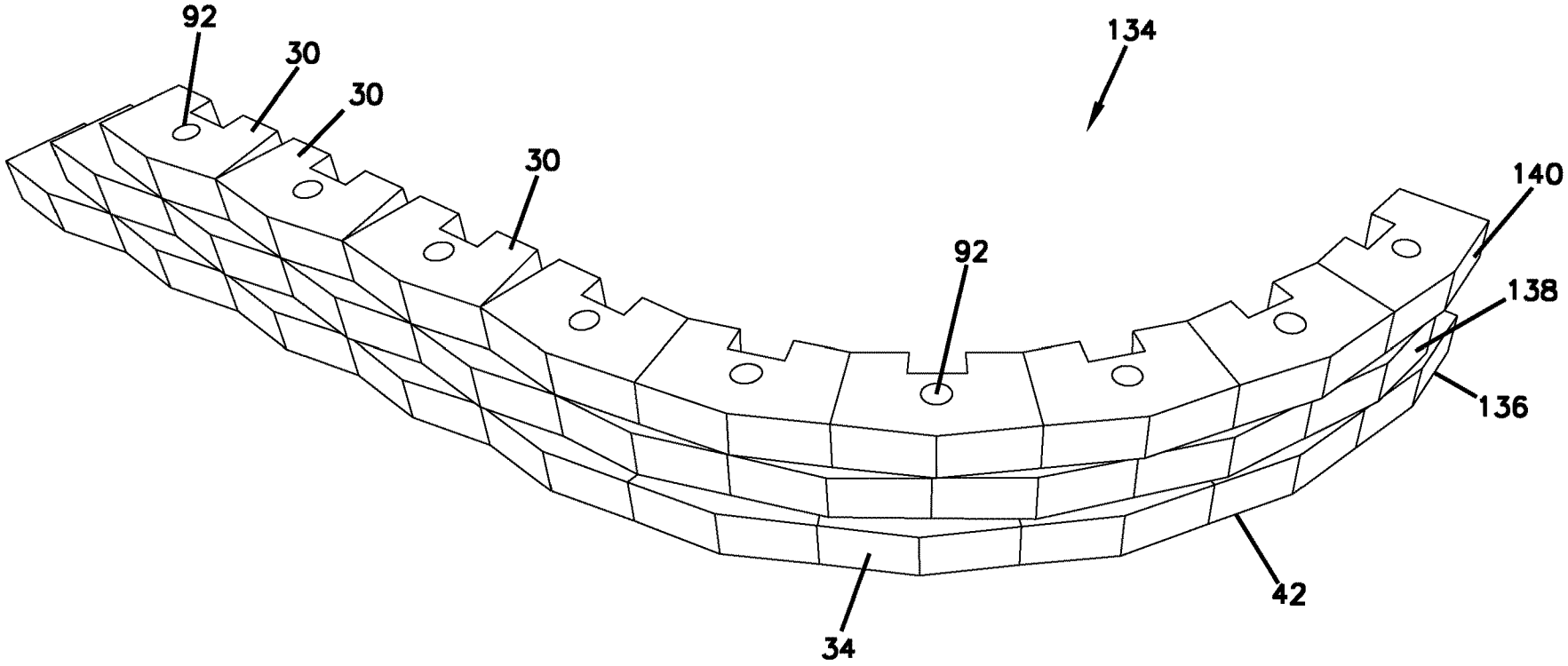
FIG. 14 is a perspective view of a retaining wall constructed from the block of FIG. 1.

The block 30 of FIG. 1 can also be used to make a retaining wall 134 (FIG. 14). The retaining wall 134 can be constructed by forming the first course 136 with the first bearing face 42 against the ground surface. The lugs 94, 96 can be removed from the blocks forming the first course 136, if desired.

Figure 15:
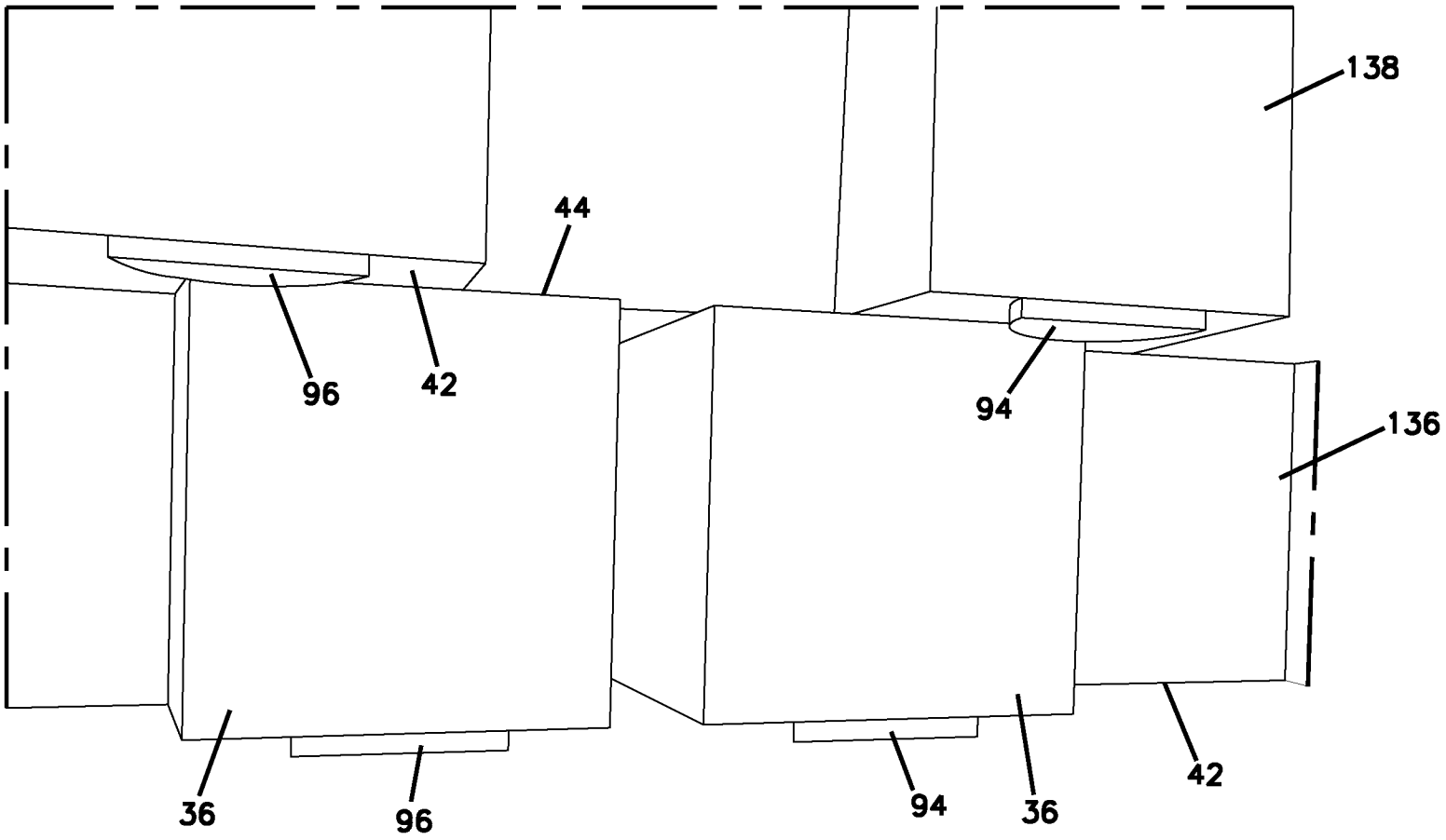
FIG. 15 is a perspective view of an enlarged portion of the retaining wall of FIG. 14.

The second course 138 is stacked on top of the first course 136 and includes using the first and second lugs 94, 96 of the blocks 30 in the second course 138 to engage against the second side 36 of the blocks in the first course 136. This will give the retaining wall 138 a setback or batter. FIG. 15 shows blocks 30 in the first course 136 with blocks 30 in the second course 138 stacked on top of them. The lugs 94, 96 can be seen engaging against the second side 36 of the blocks 30 in the first course 136. It should be noted that in this illustration, the blocks 30 of the first course 136 still have their lugs 94, 96, but those lugs can be removed if desired.

The retaining wall 134 in FIG. 14 has a third course 140 stacked on top of the second course 138. The blocks 30 in the third course 140 are arranged so that the first bearing face 42 of the blocks 30 in the third course 140 are against the second bearing face 44 of the blocks 30 in the second course 138. The lugs 94, 96 in the third course 140 are engaged against the second side 36 of the blocks 30 in the second course 138.

The resulting retaining wall 134 can be straight or it can be arranged to be curved. The retaining wall 134 in FIG. 14 is curved.

Figure 16:
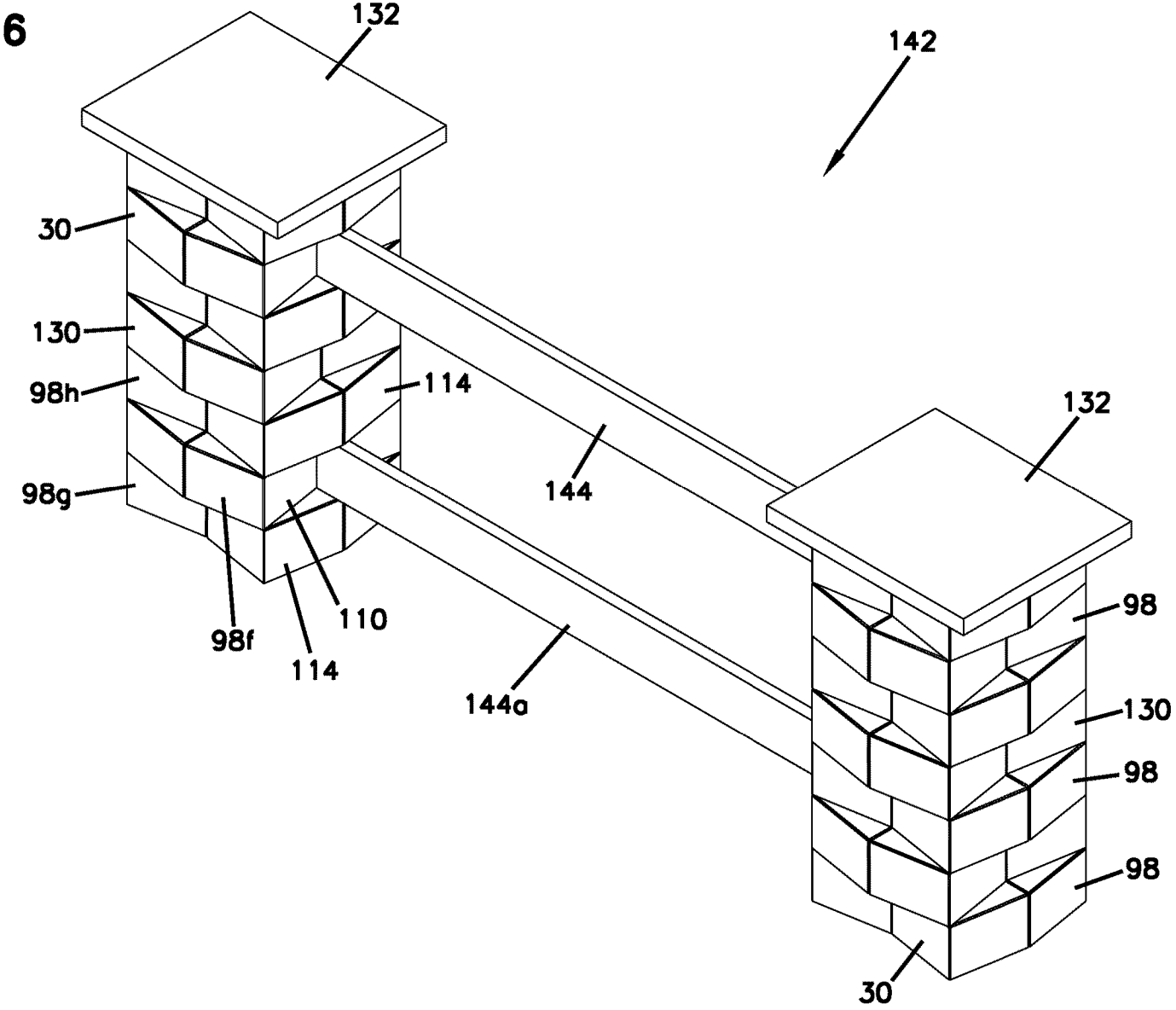
FIG. 16 is a perspective view of the block of FIG. 1 used to construct a fence.

A variety of other structures can be made from the blocks 30. FIG. 16 illustrates a fence 142. The fence 142 is made from two columns 130 spaced apart. Each column 130 can be built around another vertical structure, such as a vertically extending fence post. The block pairs 98 will have the space formed by the receivers 110, 111, which can receive a horizontally extending fence member 144. The fence member 144 will be held within the space formed by the receivers 110, 111 and then trapped or held in place by the overlapping block pair 98. In the example illustrated in FIG. 16, the fence member 144*a* is held within receiver 110 formed by a block pair 98*f*. The fence member 144*a* is then engaged and trapped in place by the projection 114 below and above it by block pair 98*g* (below) and block pair 98*h* (above).

Figure 17:
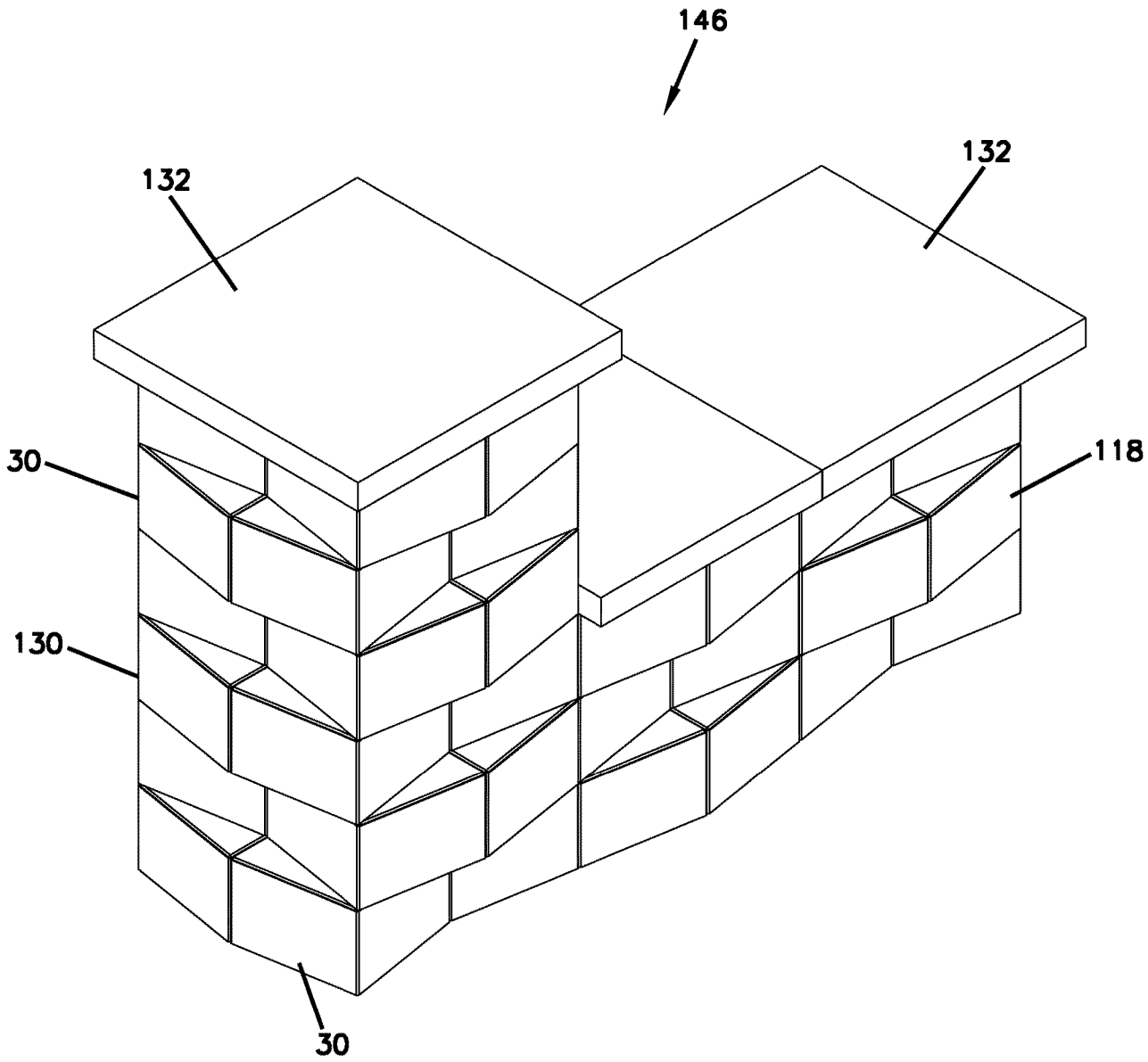
FIG. 17 is a perspective view of the block of FIG. 1 used to construct a bench and a column.

FIG. 17 illustrates a bench 146 formed by the blocks 30. The bench 146 includes a free standing wall 118 adjacent a column 130. Cap blocks 132 are on top of the free standing wall 118, which can be at a suitable height for a person to sit.

Figure 18:
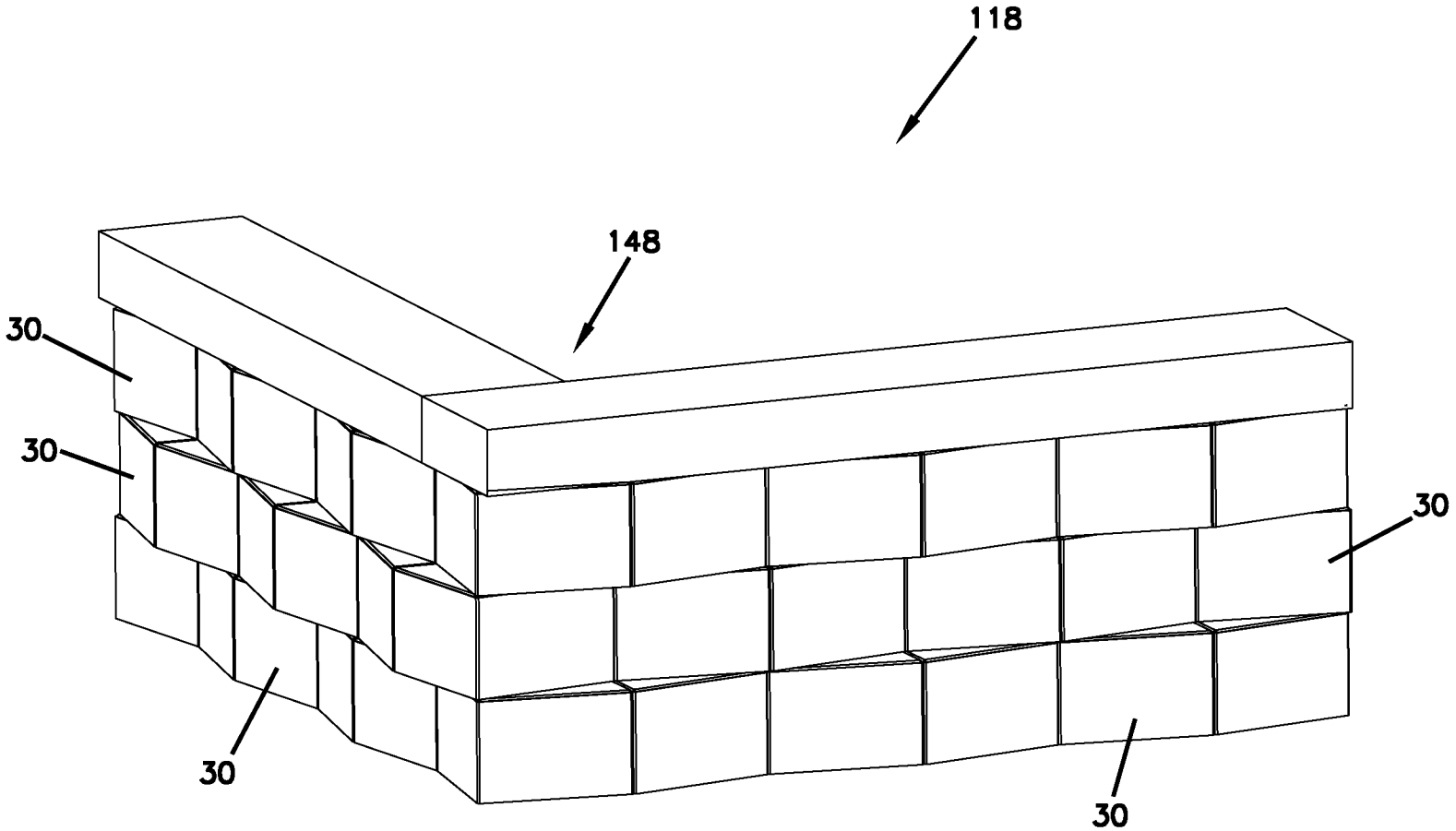
FIG. 18 is a perspective view of the block of FIG. 1 used to construct a corner garden wall.

FIG. 18 illustrates how the free standing wall 118 can be formed with corners, such as the right angle corner 148 shown in FIG. 18.

Figure 19:
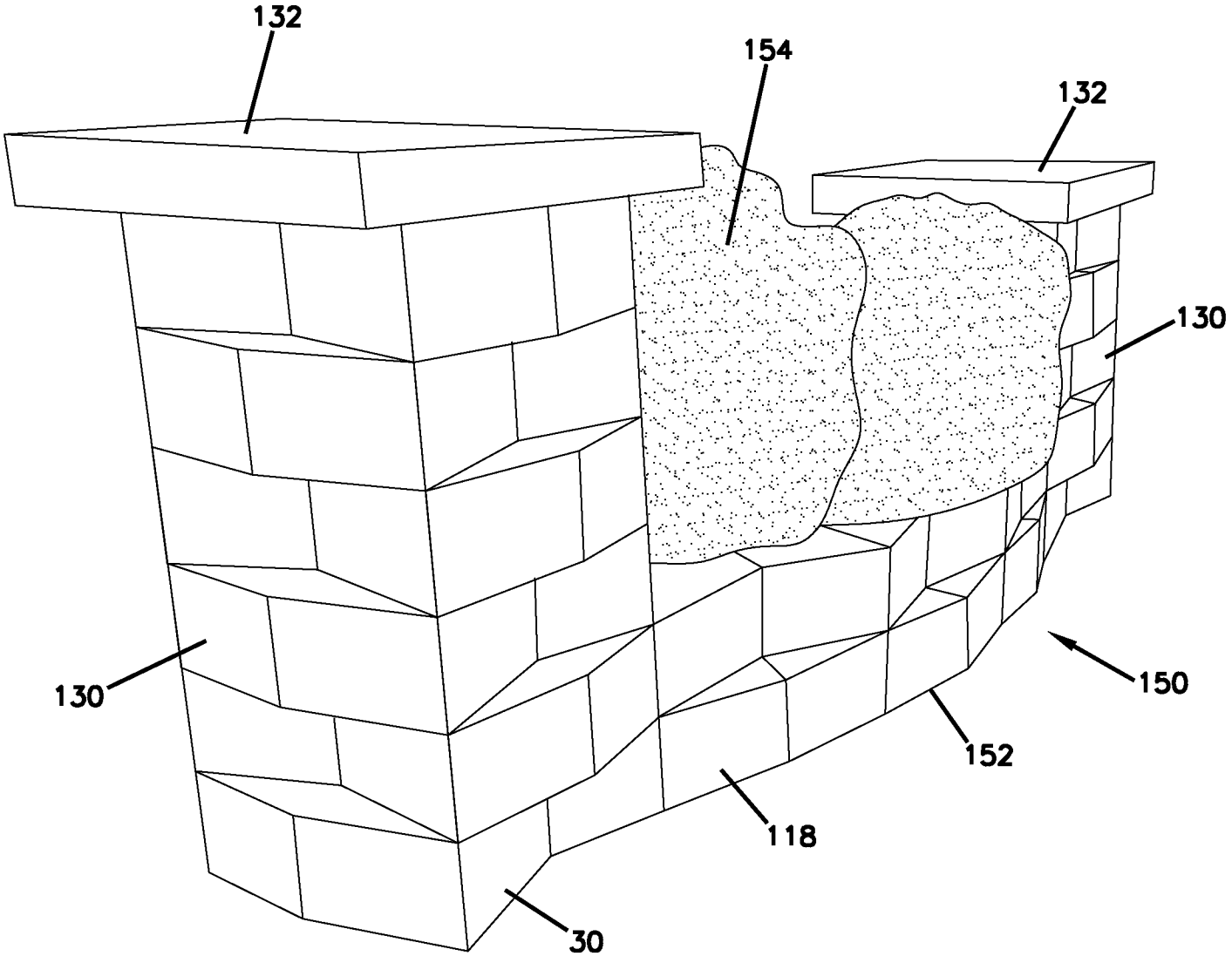
FIG. 19 is a perspective view of the block of FIG. 1 used to construct a curved garden wall.

FIG. 19 illustrates the block 30 used as a curved garden wall 150. The curved garden wall 150 includes a section 152 that formed as the free standing wall 118 with two courses extending between two columns 130. The garden wall 130 can support a region to plant flowers or bushes 154.

Figure 23:
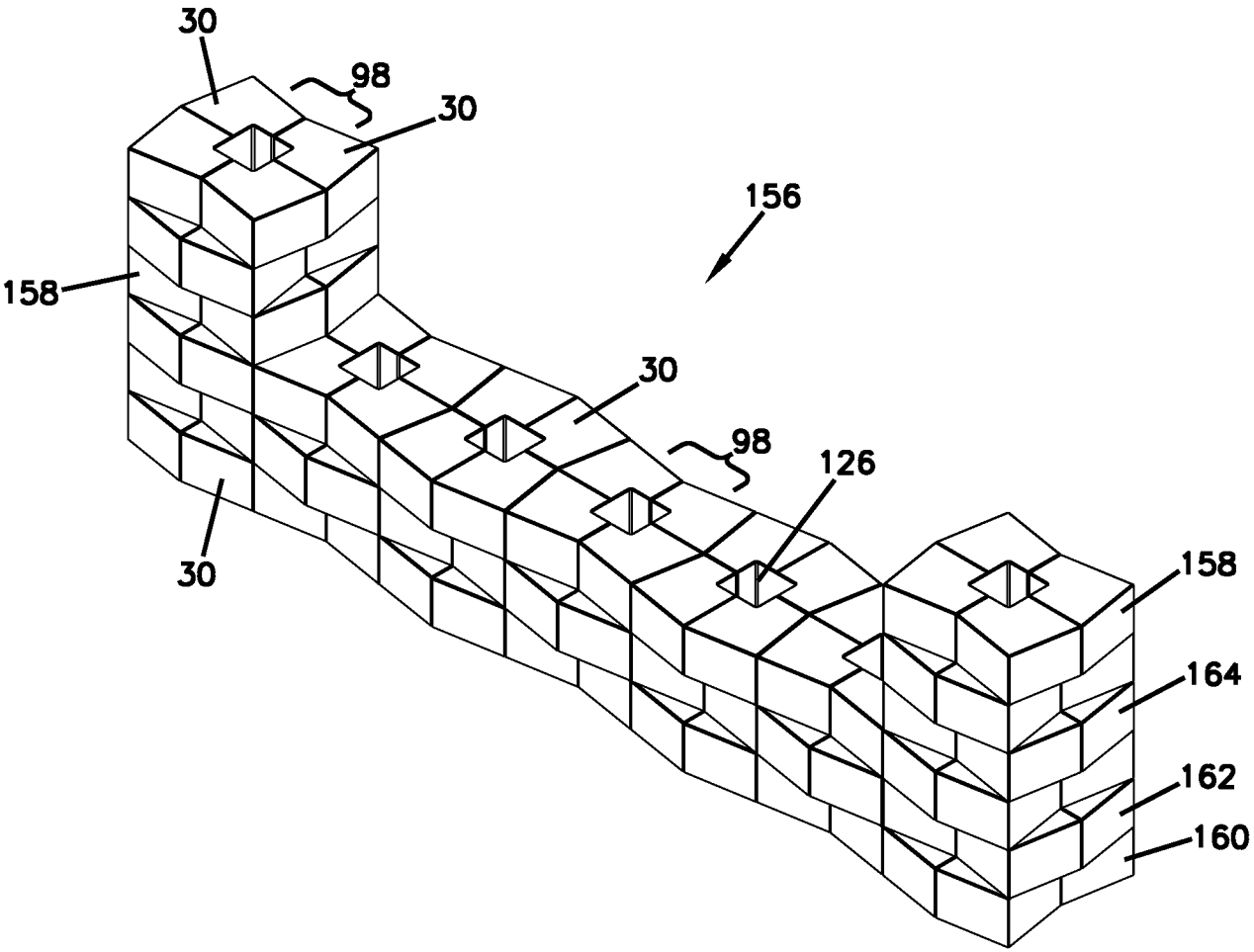
FIG. 23 is a perspective view of a free-standing wall with a column at each end of the wall constructed from the block of FIG. 20.

Turning now to the embodiment of FIG. 20, structures constructed from the block 30 of FIG. 20 are illustrated in FIGS. 23-28. In FIG. 23, a free standing wall 156 between columns 158 is illustrated. The free standing wall 156 is constructed as described above with respect to free standing wall 118, using block pairs 98, except that the FIG. 20 block does not include the positioning arrangement 90, such as core 92 and lugs 94, 96.

The free standing wall 156 is constructed by laying the first course 160 of block pairs 98 followed by the second course 162 of block pairs 98 on top of the first course 160. The third course 164 of block pairs 98 is laid on top of the second course 162. Each course 160, 162, 164 includes a plurality of the block pairs 98 arranged so that adjacent block pairs 98 have the first side 34 of one of the members of the block pair 98 opposing and against the end faces 38, 40 of first and second block members of the adjacent block pair 98. The second course 162 is placed on the first course 160 by arranging each block pair 98 ninety degrees relative to the block 98 of the proceeding course. This also allows projections 114, 115 to mate with receivers 110, 111 of adjacent block pairs 98 along each course 160, 162, 164. The courses 162, 164 in the free standing wall 156 are laid without any engagement between lugs or cores. The columns 156 are created as described with respect to the columns 130, but without any engagement between lugs and cores.

Figure 24:
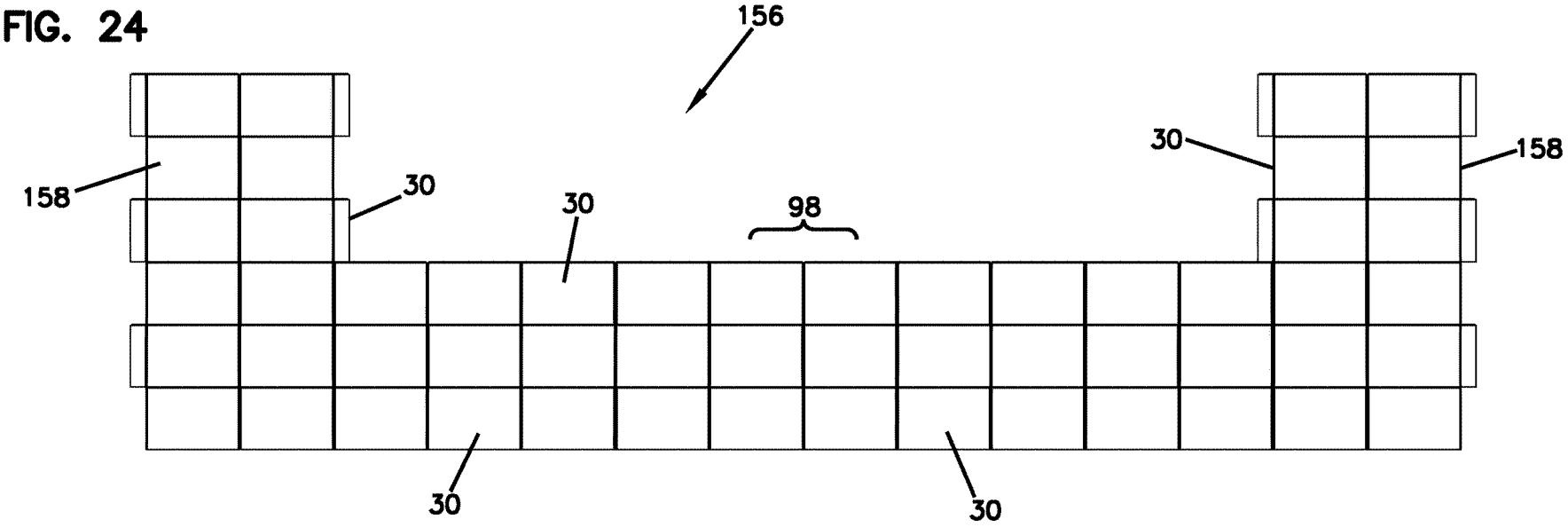
FIG. 24 is a front view of the free-standing wall of FIG. 23.
Figure 25:
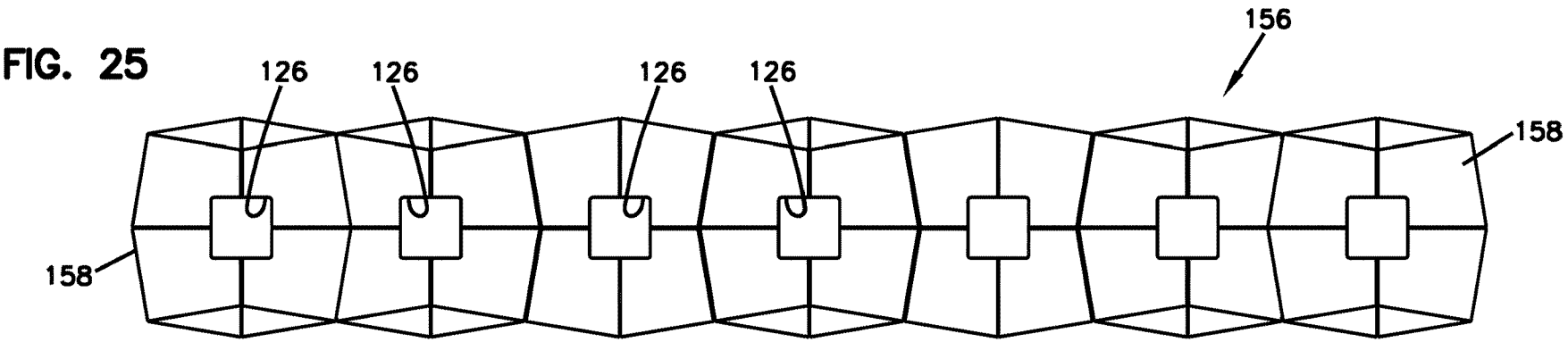
FIG. 25 is a top view of the free-standing wall of FIG. 23.
Figure 27:
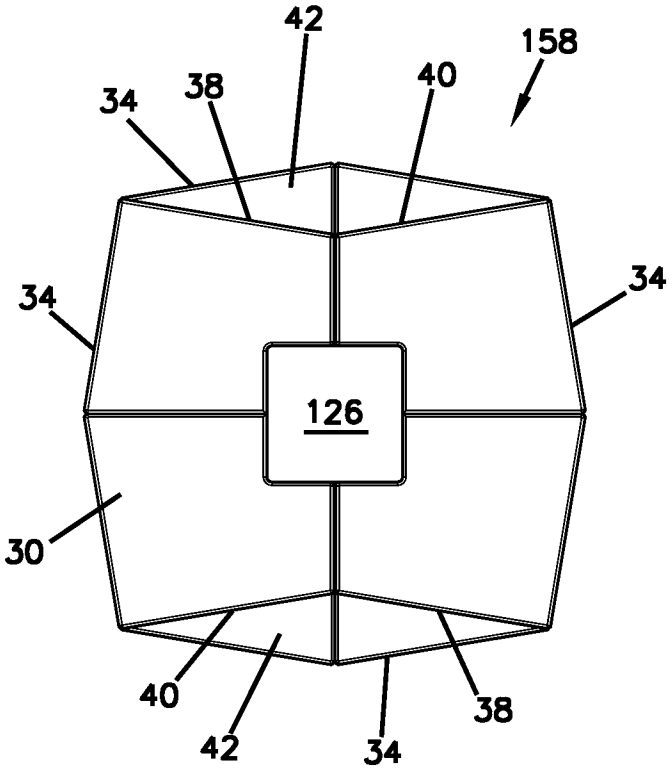
FIG. 27 is a top view of the column of FIG. 26.

FIG. 24 is a front view of the free standing wall 156 having end columns 158. FIG. 25 is top view of the free standing wall 156. Center core 126 can be seen in FIGS. 23 and 25. The center core 166 can accommodate vertically oriented structures, such as mail box posts or fence posts.

The FIG. 20 block has a shape that is advantageous in that when adjacent block pairs 98 using the block 30 of FIG. 20 are lined up next to each other, with the projections and receivers in mating engagement, there is a resistance to forces that would push the blocks 30 laterally out of alignment, or out of wall 156 when the block pairs 98 are part of wall 156.

Figure 26:
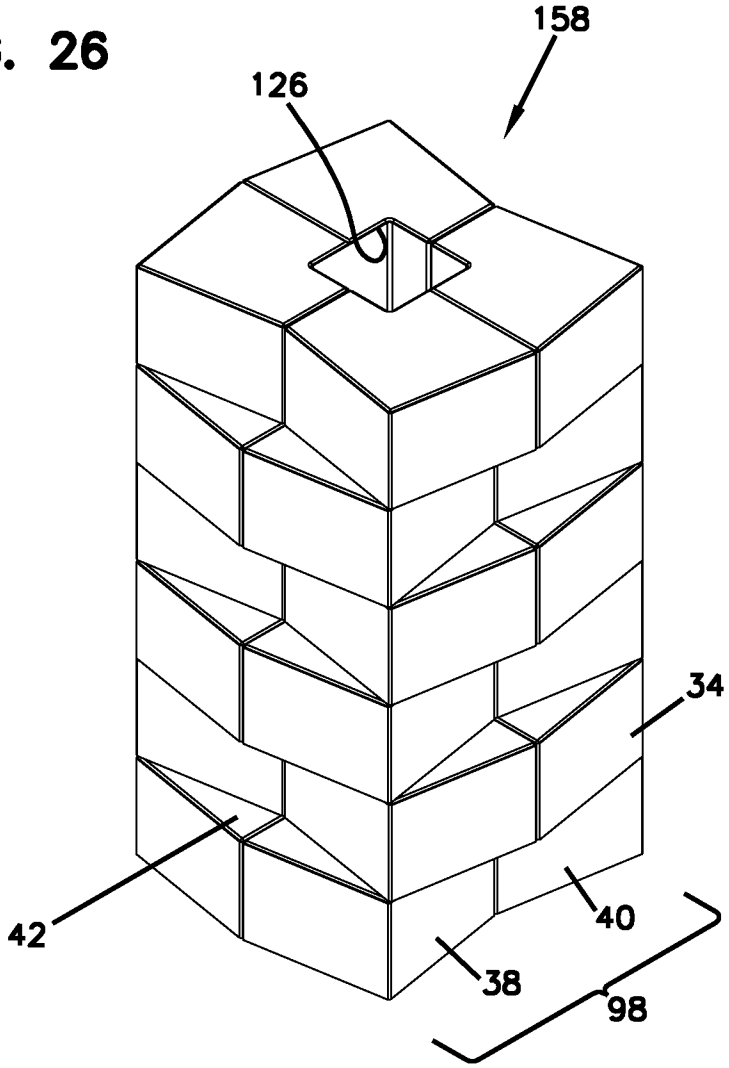
FIG. 26 is a perspective view of a column constructed from the block of FIG. 20.

FIG. 26 is a free standing column 158 built from the blocks 30 of FIG. 20. In the column 158, each course includes block pair 98 and each subsequent course has the second bearing face 44 of the block pair 98 stacked on the first bearing faces 42 of the previous course and oriented 90 degrees relative to the previous course so that the first side 34 of the block pair 98 in the subsequent course are over the end faces 38, 40 of the previous course.

Figure 28:
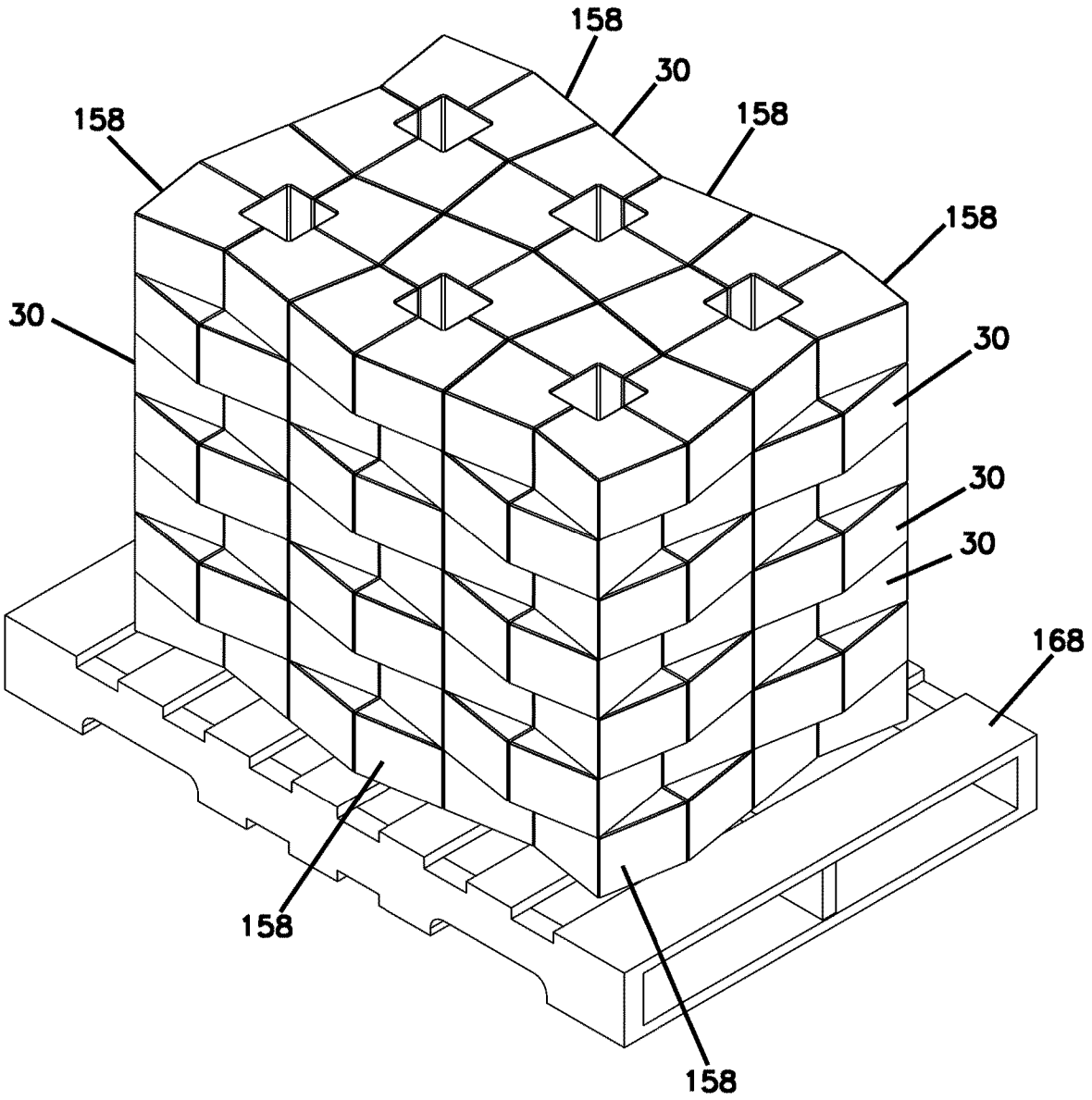
FIG. 28 is a perspective view of the block of FIG. 20 arranged on a pallet.

The blocks 30 of FIG. 20 can be stored and shipped on a pallet 168 (FIG. 28). The blocks 30, in this example, are shown stacked into six columns 158. Each column 158 has seven courses, but there can be many variations. The columns are shown in two rows, three across. In this example, the pallet 168 is holding 84 blocks 30.

Figure 30:
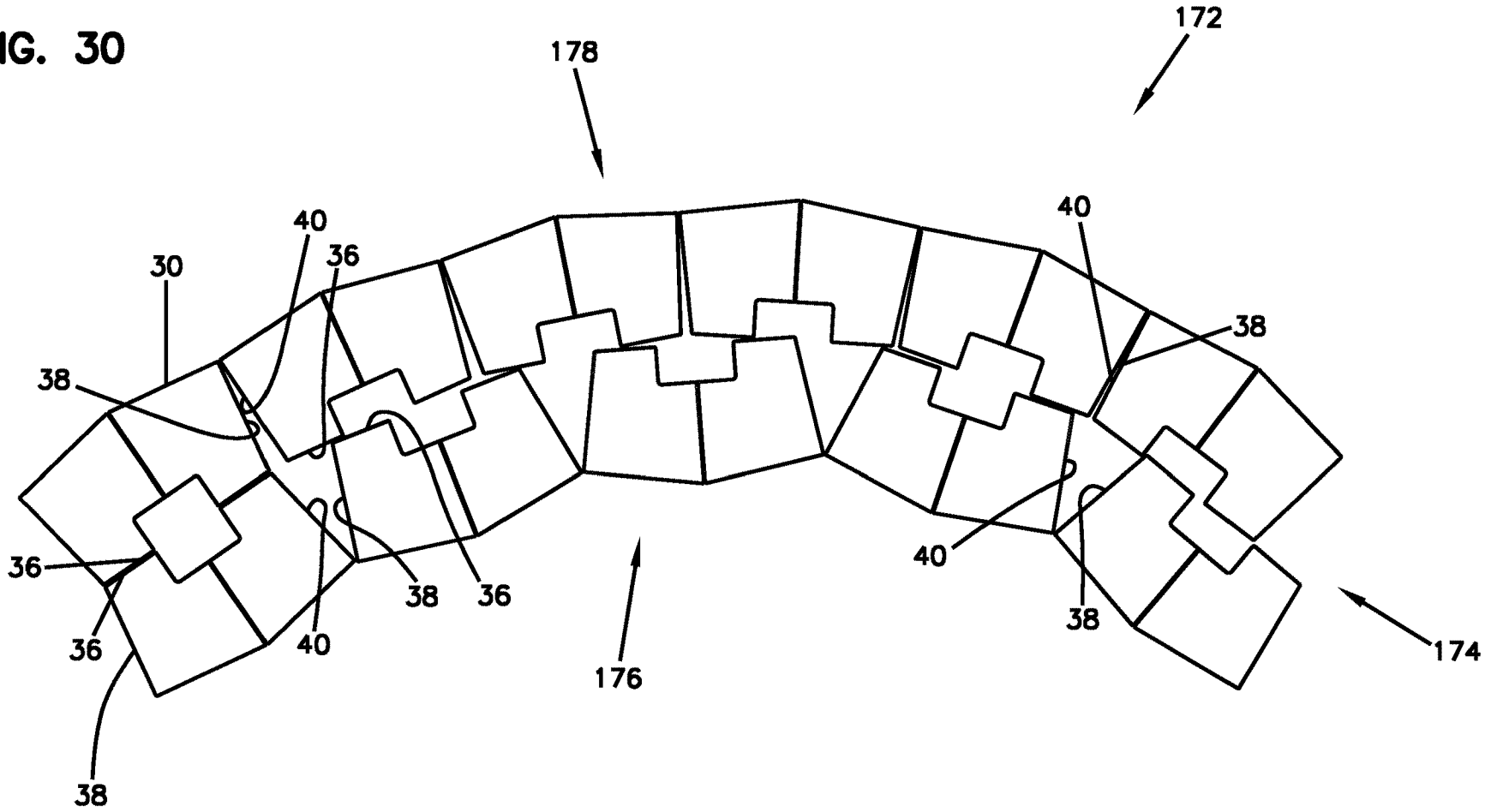
FIG. 30 is a top view of a base course of a curved, free-standing wall constructed from the block of FIG. 20.
Figure 31:
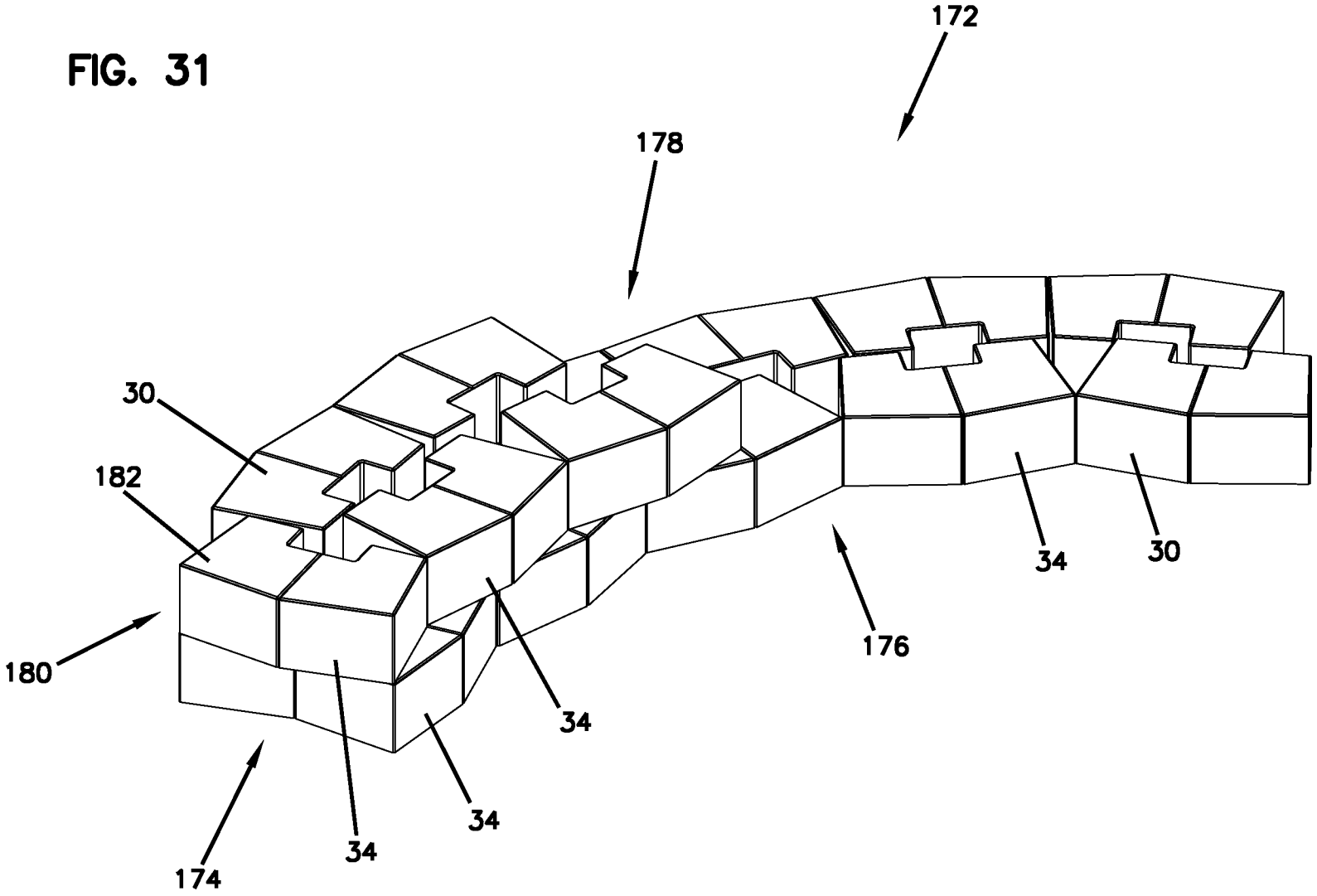
FIG. 31 is a perspective view of the base course of the free-standing wall of FIG. 30, with a partial second course laid on top of the base course.
Figure 32:
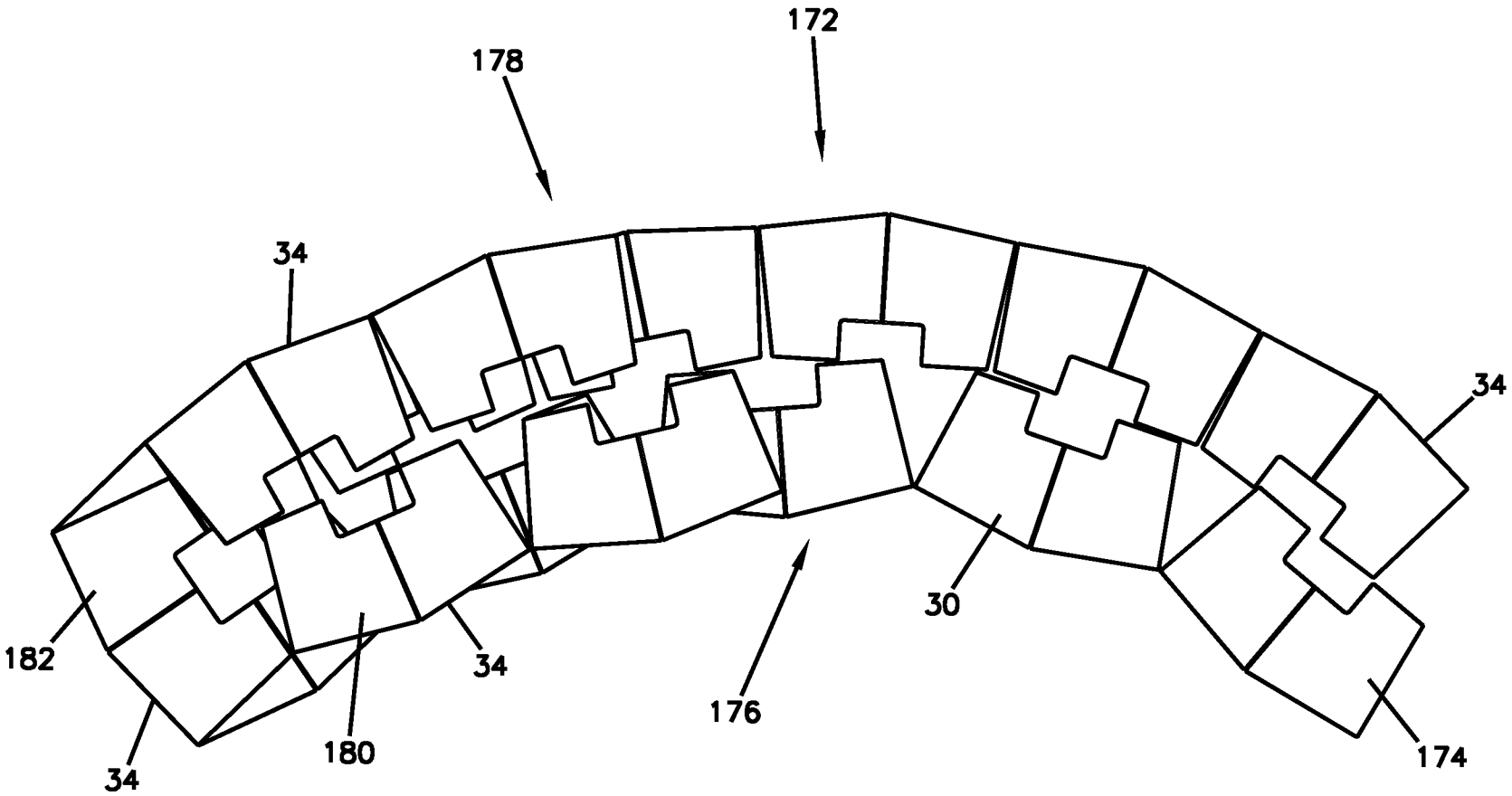
FIG. 32 is a top view of FIG. 31.

The blocks 30 of FIG. 20 can be used to make a curved back-to-back free-standing wall 172. A top view of a base (or first) course 174 is shown in FIG. 30. The angled end faces 38, 40 allow making of curved walls with a convex and concave radius. As can be seen in FIG. 30, to make the curved free-standing wall 172, the second side 36 of two blocks 30 are oriented to oppose each other. The blocks 30 along the concave side 176 of the wall 172 have their end faces 38, 40 spaced farther apart than the blocks 30 along the convex side 178 of the wall 172. FIGS. 31 and 32 show the wall 172 with the start of a second course 180 oriented on the first course 174. An end block 182 can be placed on top of the end of the first course 174 and oriented 90° to the orientation of the blocks 30 in the first course 174, while the remaining blocks in the second course 180 have generally the same orientation as the first course 174 with the first side 34 facing the outside of the wall 172. Further courses can be added until the wall 172 is the desired height.

Figure 33:
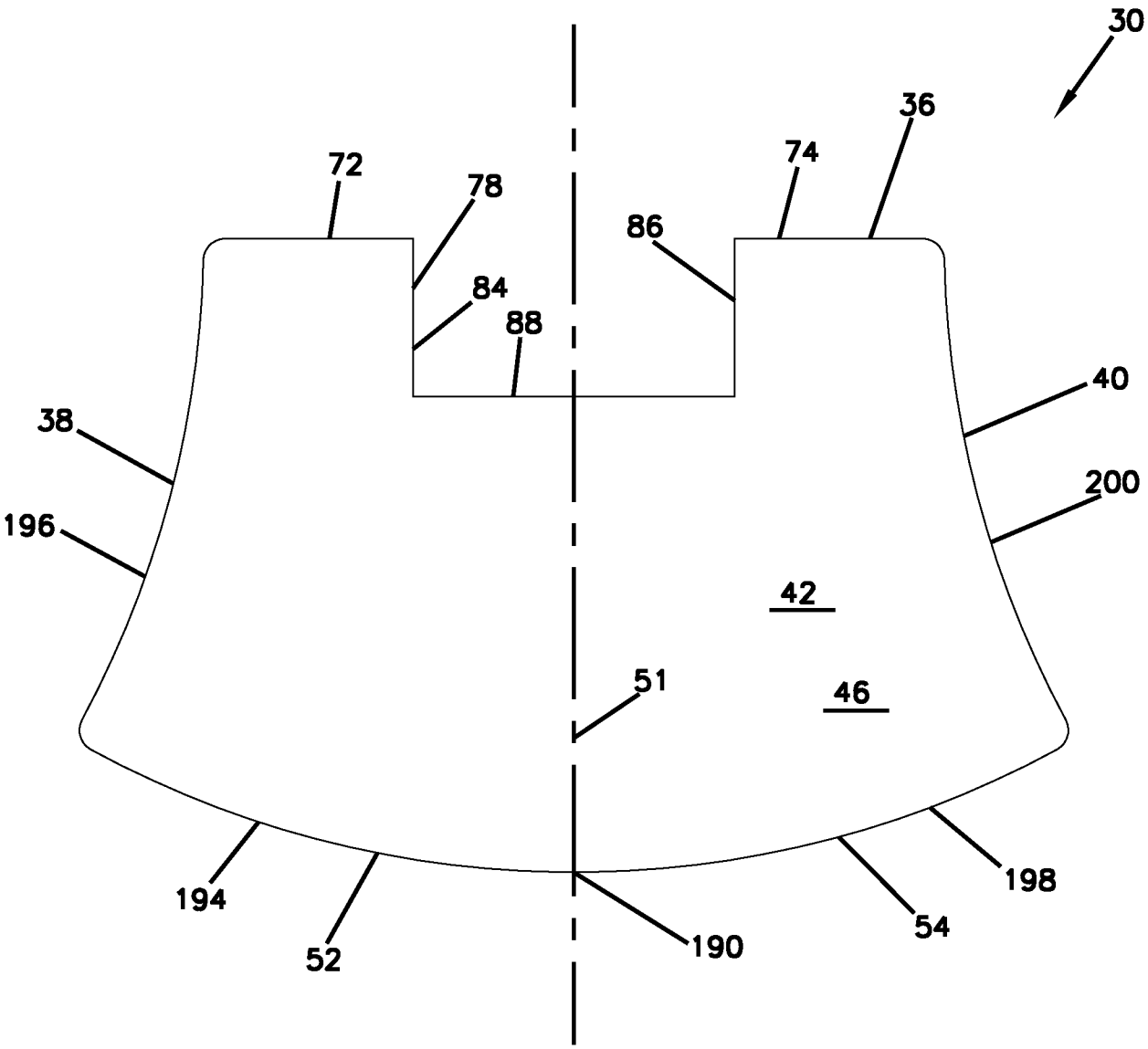
FIG. 33 is a top view of another embodiment of a concrete building block, constructed in accordance with principles of this disclosure.

Referring now to the block 30 of FIG. 33, as mentioned above, the first section 52 and the first end face 38 are shaped to mate with each other when a like block 30 is rotated 90° and oriented adjacent so that the center plane along line 51 for the two blocks 30 are perpendicular to each other. Similarly, the second section 54 and the second end face 40 are shaped to mate with each other when a like block 30 is rotated 90° so that the center plane along line 51 for the two blocks 30 are perpendicular to each other. In the FIG. 33 embodiment, there is a projection-receiver arrangement between first section 52 and first end face 38; and between second section 54 and second end face 40. The mating engagement can be in the form of curved surfaces in close contact with each other. This could include an S-curve with at least one outward curve and at least one inward curve, as well as a single curved inwardly directed surface mating with a single curved outwardly directed surface. For example, the mating engagement can be a concave/convex mating engagement. In the illustrated embodiment of FIG. 30, the concave/convex mating surfaces include the first section 52 being a convex surface 194 and the first end face 38 being a concave surface 196; and the second section 54 being a convex surface 198 and the second end face 40 being a concave surface 200.

The block 30 of FIG. 33 is not shown with a positioning arrangement 90 (e.g., lugs 94, 96; and core 92), but it should be understood that the block 30 can include such a positioning arrangement.

Figure 34:
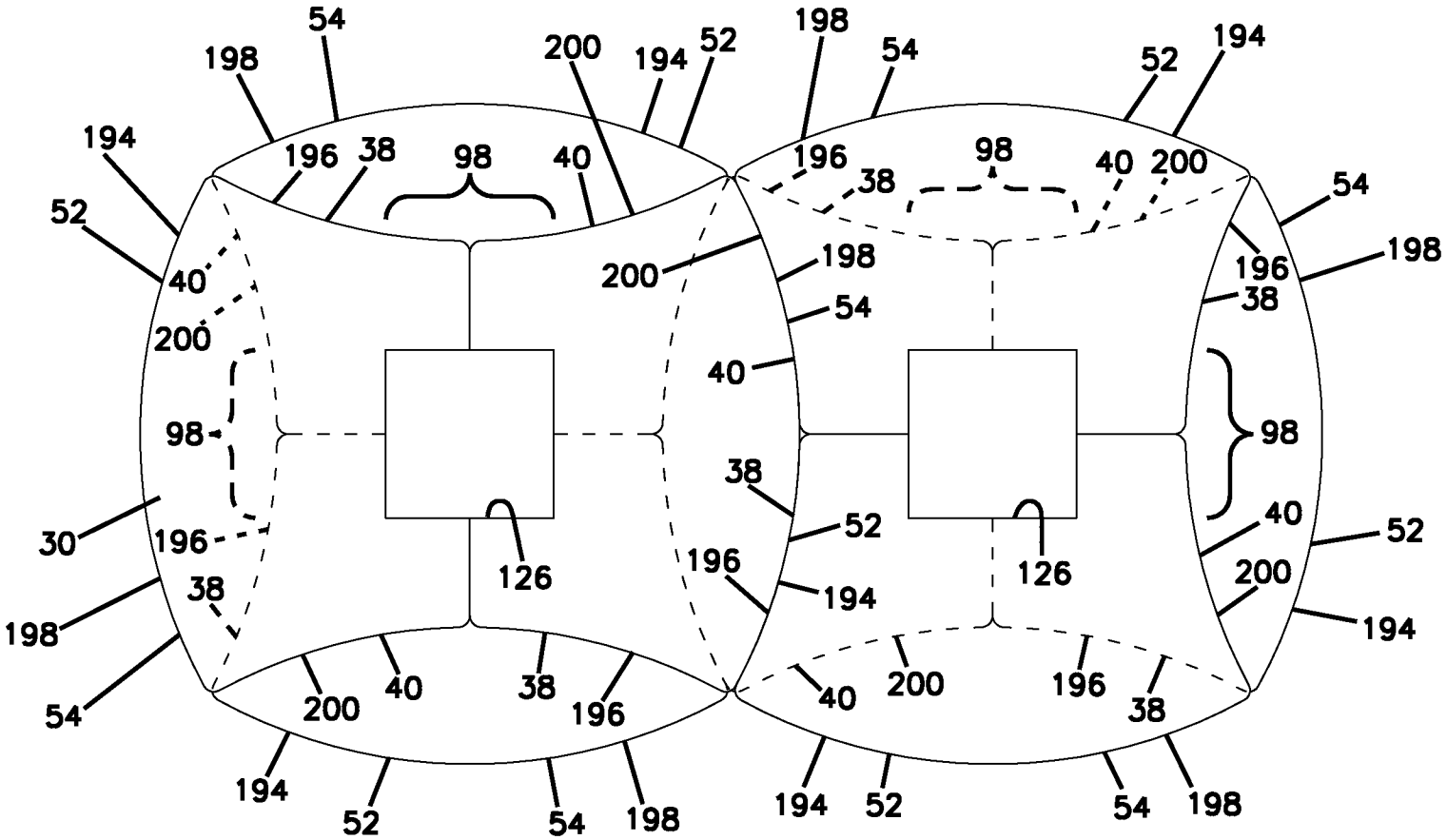
FIG. 34 is a top view of the block of 33 arranged as a block pair stacked on top of another block pair, similar to the arrangement of FIG. 10.

FIG. 34 illustrates the blocks 30 of FIG. 33 in the form of block pair 98 mating with an adjacent block pair 98, each block pair 98 being rotated 90° relative to each other. There are two courses of block pairs 98 shown in FIG. 34.

The block 30 of FIG. 33 can be used to make the same types of structures described above including free-standing walls (straight or curved), columns, columns around posts, retaining walls, garden walls, benches, fences, etc.

Referring now to the block 30 of FIG. 35, as mentioned above, the first section 52 and the first end face 38 are shaped to mate with each other when a like block 30 is rotated 90° and oriented adjacent so that the center plane along line 51 for the two blocks 30 are perpendicular to each other. Similarly, the second section 54 and the second end face 40 are shaped to mate with each other when a like block 30 is rotated 90° so that the center planes along line 51 for the two blocks 30 are perpendicular to each other. In the FIG. 35 embodiment, there is a projection-receiver arrangement between first section 52 and first end face 38; and between second section 54 and second end face 40. In the illustrated embodiment of FIG. 35, the mating engagement includes the first section 52 being an outward angled surface 210 and the first end face 38 being an inward angled surface 212; and the second section 54 being an outward angled surface 214 and the second end face 40 being an inward angled surface 216. The angled surfaces 210, 212, 214, 216 are illustrated as each having one corner 210*a*, 212*a*, 214*a*, 216*a* or apex, but in other embodiments, there can be more than one corner, including multiple corners and additionally curved surfaces.

The block 30 of FIG. 35 is not shown with a positioning arrangement 90 (e.g., lugs 94, 96; and core 92), but it should be understood that the block 30 can include such a positioning arrangement.

Figure 36:
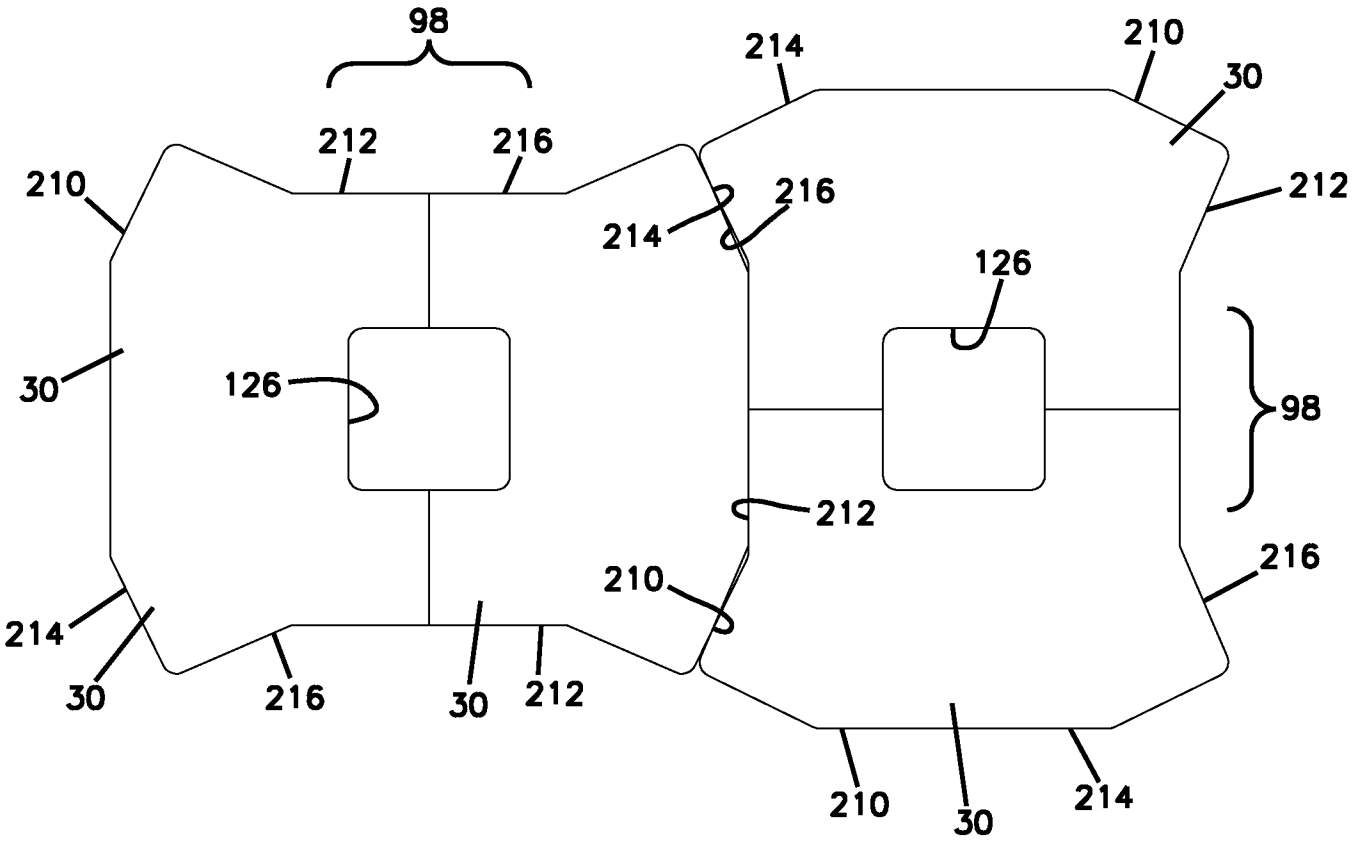
FIG. 36 is a top view of the block of FIG. 35 arranged as two block pairs adjacent to each other.

FIG. 36 illustrates the blocks 30 of FIG. 35 in the form of block pair 98 mating with an adjacent block pair 98, each block pair 98 being rotated 90° relative to each other. Angled surfaces 210 and 212; and angled surfaces 214 and 216 mate.

The block 30 of FIG. 36 can be used to make the same types of structures described above including free-standing walls (straight or curved), columns, columns around posts, retaining walls, garden walls, benches, fences, etc.

The block 30 of FIGS. 1, 20, 33, and 35 are molded from concrete, preferably, dry cast concrete and can have a variety of sizes and dimensions. For example, for the FIG. 1 block, the first side 34 can have a length of about 13-15 inches; the second side 36 can have a length between about 11-13 inches; the first and second end faces 38, 40 can have a length of about 6-8 inches; and an overall height between the first and second bearing faces 42, 44 of about 3-5 inches. The height of the lugs 94, 96 can be about 0.2-0.5 inches. The extension angles 58, 62, 66, and 70 can be about 9-10 degrees. The depth of the inset 76 between the segments 72, 74 and the inset wall 88 can be about 1-3 inches.

The blocks 30 can be put through a tumbling process to give them a weathered, distressed appearance, if desired.

For the block 30 of FIG. 20, the dimensions can be the same as the FIG. 1 block, or it can vary. For example, the FIG. 20 block can have a length along the first side 34 of between 11-13 inches; a length along the second side 36 of 9-11 inches; a length of the first and second end faces 38-40 of 5-7 inches; and a height between the first and second bearing faces 42-44 of about 3-4 inches. The depth of the inset 76 between the segments 72, 74 and the third inset wall 88 can be about 1-3 inches. The extension angles 58, 62, 66, 70 can be about 9-10 degrees.

What is claimed is:

1. A concrete building block comprising:

(a) a body having opposite first and second sides, opposite first and second end faces extending between the first and second sides, and opposite first and second bearing faces extending between the first and second sides and the first and second end faces;

(i) the first bearing face being an upper face in use and having a contact surface portion that is planar;

(ii) the second bearing face having a contact surface portion that is planar and parallel to the contact surface portion of the first bearing face;

(b) the first side of the body having a center plane that is orthogonal to the first and second bearing faces, the center plane bisecting the first side between a first section and second section;

(i) the first section having a first section length and being angled inwardly at a first extension angle relative to a plane orthogonal to the center plane, the first section extending to the center plane in extension from the first end face;

(ii) the second section having a second section length and being angled inwardly at a second extension angle relative to a plane orthogonal to the center plane, the second section extending to the center plane in extension from the second end face;

(c) the first end face having a first end face length and is angled at a third extension angle in a direction toward the second end face, as the first end face extends from the first section of the first side to the second side; and (d) the second end face having a second end face length and is angled at a fourth extension angle in a direction toward the first end face, as the second end face extends from the second section of the first side to the second side;

wherein the first section length, second section length, first end face length, and second end face length are the same; and wherein the first, second, third, and fourth extension angles are the same;

(e) the second side of the body includes a first segment and a second segment with an inset between the first segment and second segment;

(i) the inset including an inset wall extending between the first and second bearing faces;

(ii) the first segment having a first segment length extending between the first end face and the inset wall;

(iii) the second segment having a second segment length extending between the second end face and the inset wall; and (iv) at least a portion of the inset wall being closer to the first side of the body than each of the first segment and second segment;

(f) the body includes a through core from the first bearing face to the second bearing face; and (g) the first bearing face includes first and second lugs projecting therefrom, the first and second lugs fitting into a respective core of two like blocks stacked with the two like block second bearing faces against the first bearing face.

2. The building block of claim 1 wherein:

(a) the through core has a circular cross-section; and (b) the first and second lugs have semi-circular cross-sections.

3. The building block of claim 1 wherein the first and second lugs are adjacent the second side.

4. The building block of claim 1 wherein:

(a) the through core has a cross-section in a shape of a regular polygon; and (b) the first and second lugs each has a shape that can both be received together by the through core.

5. The building block of claim 1 wherein:

(a) the second side of the body includes a first segment and a second segment with an inset between the first segment and second segment;

(i) the inset including an inset wall extending between the first and second bearing faces;

(ii) the first segment having a first segment length extending between the first end face and the inset wall;

(iii) the second segment having a second segment length extending between the second end face and the inset wall; and (iv) at least a portion of the inset wall being closer to the first side of the body than each of the first segment and second segment;

(b) the first lug is adjacent the first segment; and (c) the second lug is adjacent the second segment.

6. The building block of claim 5 wherein:

(a) the through core is bisected by the center plane;

(b) the through core has a circular cross-section; and (c) the first and second lugs have semi-circular cross-sections.

7. The building block of claim 1 wherein the through core is bisected by the center plane; and wherein the block comprises dry cast concrete.

8. A wall comprising:

(a) a plurality of blocks according to claim 1 arranged in multiple courses.

9. A column comprising:

a plurality of the blocks arranged in multiple courses; each of the blocks comprising, (a) a body having opposite first and second sides, opposite first and second end faces extending between the first and second sides, and opposite first and second bearing faces extending between the first and second sides and the first and second end faces;

(i) the first bearing face being an upper face in use and having a contact surface portion that is planar;

(ii) the second bearing face having a contact surface portion that is planar and parallel to the contact surface portion of the first bearing face;

(b) the first side of the body having a center plane that is orthogonal to the first and second bearing faces, the center plane bisecting the first side between a first section and second section;

(i) the first section having a first section length and being angled inwardly at a first extension angle relative to a plane orthogonal to the center plane, the first section extending to the center plane in extension from the first end face;

(ii) the second section having a second section length and being angled inwardly at a second extension angle relative to a plane orthogonal to the center plane, the second section extending to the center plane in extension from the second end face;

(c) the first end face having a first end face length and is angled at a third extension angle in a direction toward the second end face, as the first end face extends from the first section of the first side to the second side; and (d) the second end face having a second end face length and is angled at a fourth extension angle in a direction toward the first end face, as the second end face extends from the second section of the first side to the second side;

wherein the first section length, second section length, first end face length, and second end face length are the same; and wherein the first, second, third, and fourth extension angles are the same;

(e) the second side of the body includes a first segment and a second segment with an inset between the first segment and second segment;

(i) the inset including an inset wall extending between the first and second bearing faces;

(ii) the first segment having a first segment length extending between the first end face and the inset wall;

(iii) the second segment having a second segment length extending between the second end face and the inset wall; and (iv) at least a portion of the inset wall being closer to the first side of the body than each of the first segment and second segment;

wherein (i) each course comprising a block pair, each block pair including a first block member and a second block member with the first and second segments opposing and against each other; and (ii) each subsequent course having the second bearing face of the first and second block members of the block pair stacked on the first bearing faces of the previous course and oriented 90° relative to the previous course so that the first sides of the block pair in the subsequent course are over the end faces of the previous course.

10. A concrete building block comprising:

(a) a body having opposite first and second sides, opposite first and second end faces extending between the first and second sides, and opposite first and second bearing faces extending between the first and second sides and the first and second end faces;

(i) the first bearing face being an upper face in use and having a contact surface portion that is planar;

(ii) the second bearing face having a contact surface portion that is planar and parallel to the contact surface portion of the first bearing face;

(iii) the body including a through core from the first bearing face to the second bearing face;

(b) the first side of the body having a center plane that is orthogonal to the first and second bearing faces, the center plane bisecting the first side between a first section and second section;

(i) the first section having a first section length and being angled inwardly at a first extension angle relative to a plane orthogonal to the center plane, the first section extending to the center plane in extension from the first end face;

(ii) the second section having a second section length and being angled inwardly at a second extension angle relative to a plane orthogonal to the center plane, the second section extending to the center plane in extension from the second end face;

(c) the first end face having a first end face length and is angled at a third extension angle in a direction toward the second end face, as the first end face extends from the first section of the first side to the second side;

(d) the second end face having a second end face length and is angled at a fourth extension angle in a direction toward the first end face, as the second end face extends from the second section of the first side to the second side;

wherein, (i) the first section length, second section length, first end face length, and second end face length are the same;

(ii) the first, second, third, and fourth extension angles are the same; and (iii) the first bearing face includes first and second lugs projecting therefrom, the first and second lugs fitting into a respective core of two like blocks stacked with the two like block second bearing faces against the first bearing face.

11. The building block of claim 10 wherein the first, second, third, and fourth extension angles are a non-zero angle less than 20 degrees.

12. The building block of claim 10 wherein:

(a) the through core has a circular cross-section; and (b) the first and second lugs have semi-circular cross-sections.

13. The building block of claim 10 wherein the first and second lugs are adjacent the second side.

14. The building block of claim 10 wherein:

(a) the through core has a cross-section in a shape of a regular polygon; and (b) the first and second lugs each has a shape that can both be received together by the through core.

15. The building block of claim 10 wherein:

(a) the second side of the body includes a first segment and a second segment with an inset between the first segment and second segment;

(i) the inset including an inset wall extending between the first and second bearing faces;

(ii) the first segment having a first segment length extending between the first end face and the inset wall;

(iii) the second segment having a second segment length extending between the second end face and the inset wall; and (iv) at least a portion of the inset wall being closer to the first side of the body than each of the first segment and second segment;

(b) the first lug is adjacent the first segment; and (c) the second lug is adjacent the second segment.

16. The building block of claim 15 wherein:

(a) the through core is bisected by the center plane;

(b) the through core has a circular cross-section; and (c) the first and second lugs have semi-circular cross-sections.

17. The building block of claim 10 wherein the through core is bisected by the center plane; and wherein the block comprises dry cast concrete.

* * * * *